US009170513B2

(12) United States Patent
Mori et al.

(10) Patent No.: US 9,170,513 B2
(45) Date of Patent: Oct. 27, 2015

(54) YELLOW TONER

(71) Applicant: CANON KABUSHIKI KAISHA, Tokyo (JP)

(72) Inventors: Shosei Mori, Hiratsuka (JP); Takeshi Sekiguchi, Tokyo (JP); Yuko Katsumoto, Yokohama (JP); Taichi Shintou, Saitama (JP); Takayuki Ujifusa, Ashigarakami-gun (JP); Takeshi Miyazaki, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/183,440

(22) Filed: Feb. 18, 2014

(65) Prior Publication Data

US 2014/0170553 A1 Jun. 19, 2014

Related U.S. Application Data

(63) Continuation of application No. PCT/JP2013/005055, filed on Aug. 27, 2013.

(30) Foreign Application Priority Data

Aug. 30, 2012 (JP) ..... 2012-190503

(51) Int. Cl.
*G03G 9/09* (2006.01)
*G03G 9/12* (2006.01)

(52) U.S. Cl.
CPC ..... *G03G 9/091* (2013.01); *G03G 9/122* (2013.01)

(58) Field of Classification Search
CPC ..... G03G 9/091; G03G 9/122
USPC ..... 430/108.23, 114
See application file for complete search history.

(56) References Cited

U.S. PATENT DOCUMENTS

| | | | | |
|---|---|---|---|---|
| 7,014,969 | B2 * | 3/2006 | Yachi et al. | 430/108.7 |
| 7,833,685 | B2 | 11/2010 | Tanaka et al. | |
| 8,211,606 | B2 | 7/2012 | Murai et al. | |
| 2010/0035171 | A1 | 2/2010 | Watanabe et al. | |

FOREIGN PATENT DOCUMENTS

| | | | |
|---|---|---|---|
| GB | 1360749 | * | 7/1974 |
| JP | 61-112160 | A | 5/1986 |
| JP | 7-140716 | A | 6/1995 |
| JP | 11-282208 | A | 10/1999 |
| WO | 2009/088034 | A1 | 7/2009 |

OTHER PUBLICATIONS

International Search Report dated Oct. 22, 2013 in International Application No. PCT/JP2013/005055.
International Preliminary Report on Patentability, International Application No. PCT/JP2013/005055, Mailing Date Mar. 12, 2015.

* cited by examiner

*Primary Examiner* — Janis L Dote
(74) *Attorney, Agent, or Firm* — Fitzpatrick, Cella, Harper and Scinto

(57) ABSTRACT

The present invention provides a yellow toner having high compatibility of a colorant with a binder resin, having good chroma, and being useful for broadening the green color gamut. The yellow toner contains the binder resin and the colorant, wherein the colorant contains a compound represented by the general formula (1).

General formula (1)

4 Claims, 1 Drawing Sheet

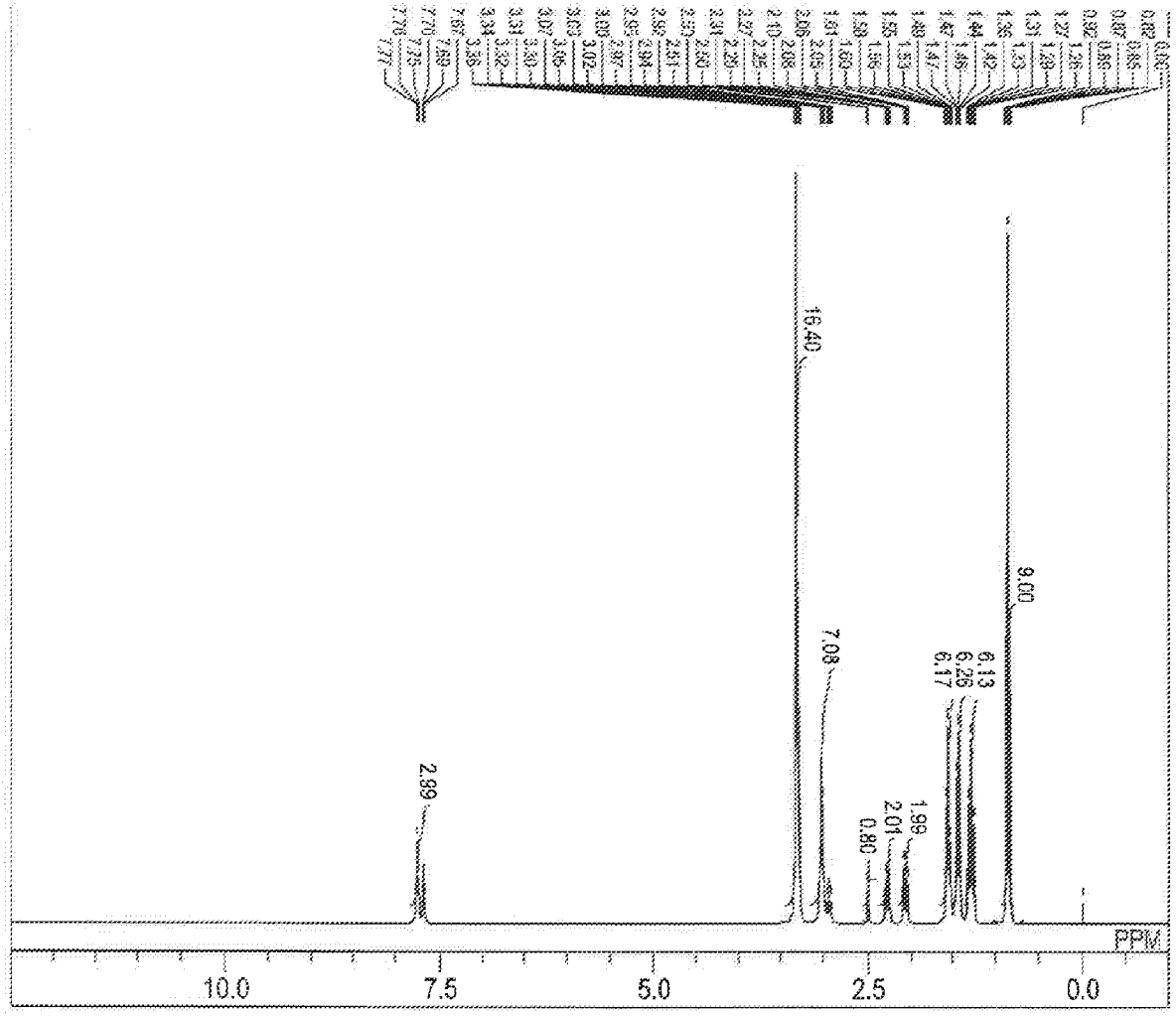
PPM
0.0
2.5
5.0
7.5
10.0
9.00
6.13
6.26
6.17
1.99
2.01
0.80
7.08
16.40
2.99

YELLOW TONER

CROSS-REFERENCE TO RELATED APPLICATIONS

This application is a continuation of International Application No. PCT/JP2013/005055, filed Aug. 27, 2013, which claims the benefit of Japanese Patent Application No. 2012-190503, filed Aug. 30, 2012.

BACKGROUND OF THE INVENTION

1. Field of the Invention

The present invention relates to yellow toners used in recording methods such as electrophotographies, electrostatic recording methods, magnetic recording methods, and toner jet methods.

2. Description of the Related Art

In recent years, color images have spread widely and the demand for high-quality images has been raised. In digital full-color copying machines and printers, color-image manuscripts are color-separated by each color filter of blue, green, and red, and thereafter, latent images corresponding to the original images are developed using each color developer of yellow, magenta, cyan, and black. Thus, the coloring power of a colorant in the each color developer largely affects the image quality.

The reproduction of color spaces including the Japan Color in print industries and AdobeRGB in DeskTop Publishing (DTP) is becoming important. For the reproduction of the color spaces, a method is known in which a dye having a broad color gamut is used in addition to improvement of dispersibility of a pigment.

Typical examples known as yellow colorants for toners are isoindolinone, quinophthalone, isoindoline, anthraquinone, and compounds having an azo skeleton or the like. Among these, some examples of yellow dyes are known which use an azo skeleton like C.I. Solvent Yellow 162 high in transparency and coloring power and excellent in light resistance (see Japanese Patent Application Laid-Open No. S61-112160, Japanese Patent Application Laid-Open No. H07-140716 and Japanese Patent Application Laid-Open No. H11-282208).

Particularly in the case of using a compound having an azo skeleton like C.I. Solvent Yellow 162 as a yellow colorant for toners, a yellow toner excellent in color development in a yellow color gamut can be obtained from the feature of the dye.

However, a further improvement is needed for making the chroma better and broadening the green color gamut.

SUMMARY OF THE INVENTION

The present invention is directed to providing a yellow toner having a good chroma and a broadened green color gamut.

According to one aspect of the present invention, there is provided a yellow toner comprising toner particles, each of which contains a binder resin and a colorant, wherein the colorant contains a compound represented by the following general formula (1).

General Formula (1)

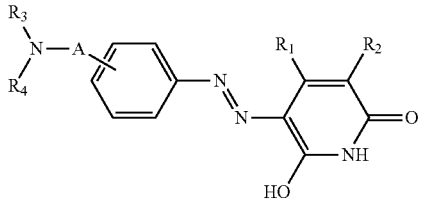

wherein $R_1$ represents an alkyl group, an aryl group, or an amino group; $R_2$ represents a carboxylate ester group or a carboxylic acid amide group; A represents a carbonyl group or a sulfonyl group; and $R_3$ and $R_4$ each independently represent an alkyl group or an aryl group.

The present invention can provide a yellow toner having a good chroma and a broadened green color gamut.

Further features of the present invention will become apparent from the following description of exemplary embodiments with reference to the attached drawings.

BRIEF DESCRIPTION OF THE DRAWINGS

FIGURE is a diagram illustrating a $^1$H-NMR spectrum at 400 MHz at room temperature of one compound (5) of compounds represented by the general formula (1) according to the present invention in DMSO-$d_6$.

DESCRIPTION OF THE EMBODIMENTS

Hereinafter, the present invention will be described in more detail by citing embodiments.

As a result of exhaustive studies to solve the problem in the above-mentioned conventional technologies, the present inventors have found that the use of a toner described below can make the chroma better and broaden the green color gamut.

That is, the present invention is a yellow toner comprising toner particles, each of which contains a binder resin and a colorant, wherein the colorant contains a compound (hereinafter, also referred to as a dye compound) represented by the following general formula (1).

General Formula (1)

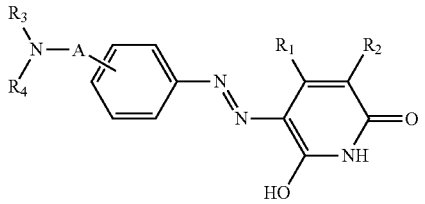

wherein $R_1$ represents an alkyl group, an aryl group, or an amino group; $R_2$ represents a carboxylate ester group or a carboxylic acid amide group; A represents a carbonyl group or a sulfonyl group; and $R_3$ and $R_4$ each independently represent an alkyl group or an aryl group.

<Colorant>

First, a compound used as a colorant and represented by the above general formula (1) will be described. A compound represented by the general formula (1) and used in the present invention has high compatibility with and high affinity for a binder resin used in the toner.

An alkyl group for $R_1$ in the general formula (1) is not especially limited, but specifically includes a methyl group, an ethyl group, a propyl group, and a butyl group.

An aryl group for $R_1$ is not especially limited, but specifically includes a phenyl group.

An amino group for $R_1$ is not especially limited, but specifically includes an unsubstituted amino group (—$NH_2$), a propylamino group, a phenylamino group, a dimethylamino group, and a dipropylamino group.

Among these, $R_1$ is preferably an alkyl group, and especially preferably a methyl group because the green color gamut can be further broadened.

A carboxylate ester group for $R_2$ in the general formula (1) is not especially limited, but specifically includes a methyl carboxylate ester group, an ethyl carboxylate ester group, a propyl carboxylate ester group, a butyl carboxylate ester group, and a 2-ethylhexyl carboxylate ester group.

A carboxylic acid amide group for $R_2$ is not especially limited, but specifically includes carboxylic acid dialkylamide groups such as a carboxylic acid dimethylamide group and a carboxylic acid diethylamide group, carboxylic acid diphenylamide groups such as a carboxylic acid diphenylamide group, carboxylic acid monoalkylamide groups such as a carboxylic acid methylamide group, a carboxylic acid ethylamide group, and a carboxylic acid t-butylamide group, and carboxylic acid monophenylamide groups such as a carboxylic acid phenylamide group.

$R_2$ is preferably a carboxylate ester group, and especially a methyl carboxylate ester group or an ethyl carboxylate ester group is useful in order to make the compatibility with a binder resin high, and the extension of the chroma good, and broaden the green color gamut.

The alkyl group for $R^3$ and $R^4$ in the general formula (1) is not especially limited, but specifically includes straight-chain, branched or cyclic primary to tertiary alkyl groups having 1 to 20 carbon atoms such as a methyl group, an ethyl group, a n-propyl group, an isopropyl group, a n-butyl group, a sec-butyl group, a tert-butyl group, an octyl group, a dodecyl group, a nonadecyl group, a cyclobutyl group, a cyclopentyl group, a cyclohexyl group, a methylcyclohexyl group, 2-ethylpropyl group, 2-ethylhexyl group, and a cyclohexenylethyl group.

An aryl group for $R_3$ and $R_4$ in the general formula (1) is not especially limited, but specifically includes a phenyl group.

$R_3$ and $R_4$ are preferably the same substituent, and represent especially preferably the same alkyl group because the solubility to a solvent becomes high.

The case where $R_3$ and $R_4$ are each independently an ethyl group, a n-butyl group, a sec-butyl group, a dodecyl group, a cyclohexyl group, a methylcyclohexyl group, a 2-ethylpropyl group, a 2-ethylhexyl group, or a cyclohexenylethyl group is preferable because the solubility to a solvent becomes high, and the green color gamut is broadened. Among these, a n-butyl group and a 2-ethylhexyl group are especially preferable.

Although compounds (1) to (25) are shown below as preferable examples of compounds represented by the general formula (1), compounds used in the present invention and represented by the general formula (1) are not especially limited to the following compounds.

Compounds having a structure represented by the general formula (1) have azo-hydrazo tautomers, and the any compounds are in the category of the present invention.

Compound (1)

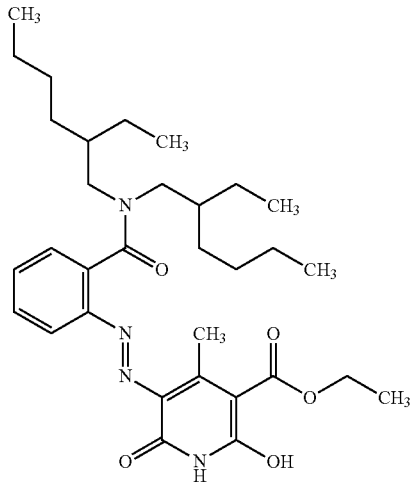

Compound (2)

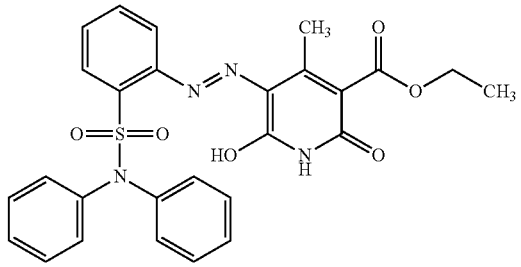

Compound (3)

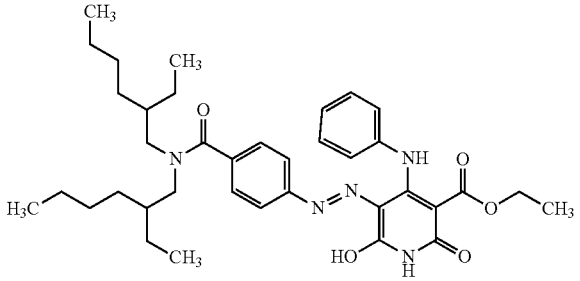

Compound (4)

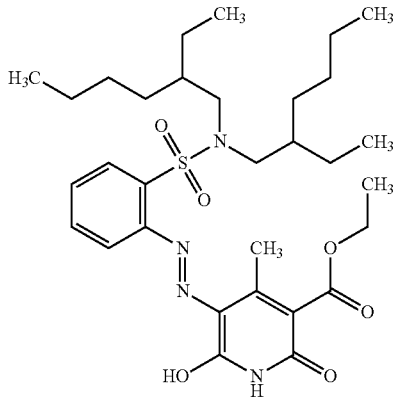

-continued
Compound (5)
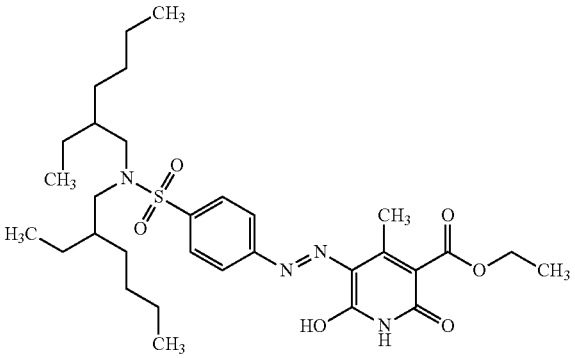
Compound (6)
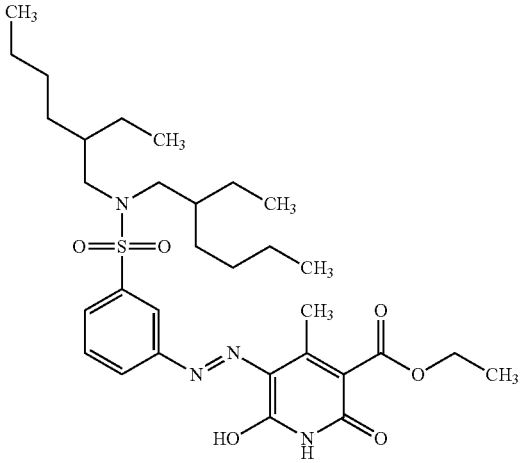
Compound (7)
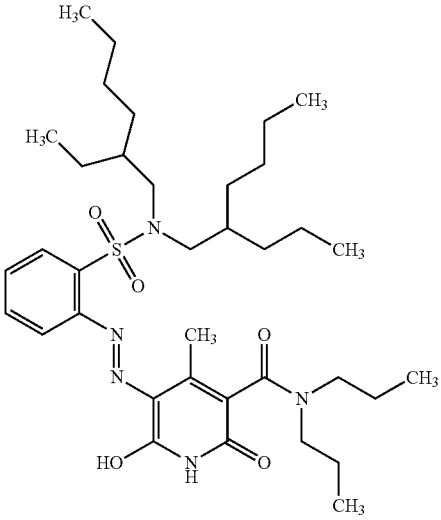
-continued
Compound (8)
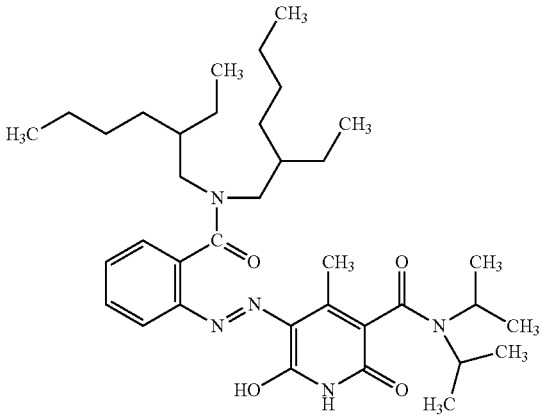
Compound (9)
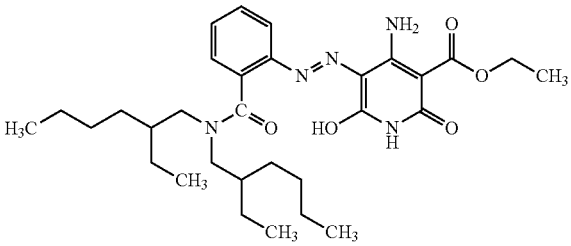
Compound (10)
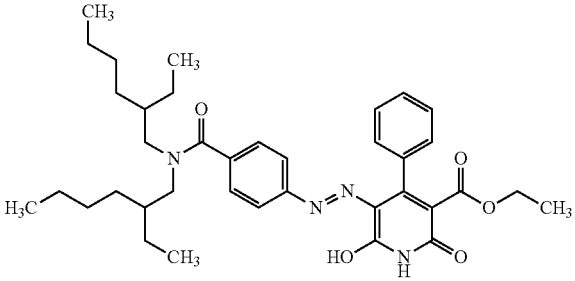
Compound (11)
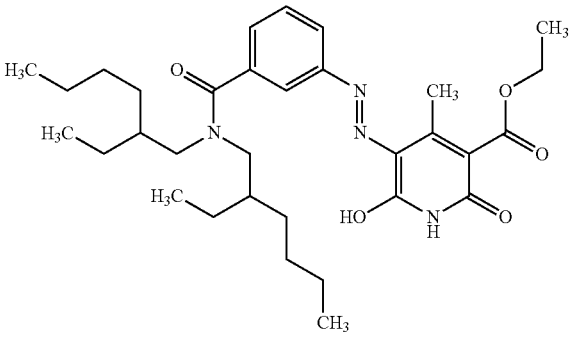

-continued
Compound (12)
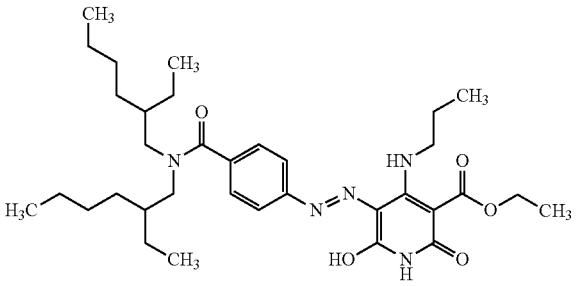
Compound (13)
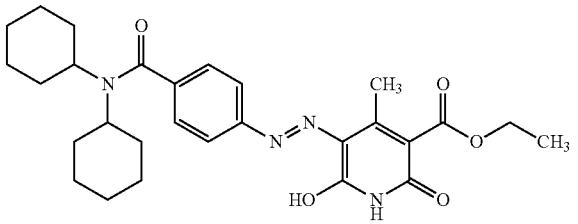
Compound (14)
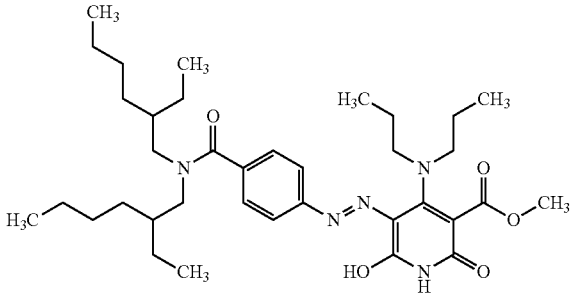
Compound (15)
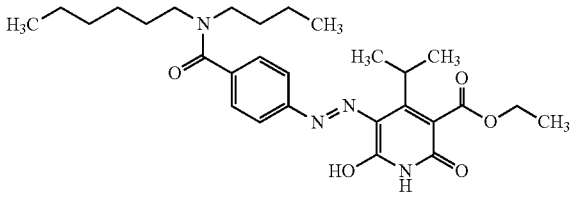
Compound (16)
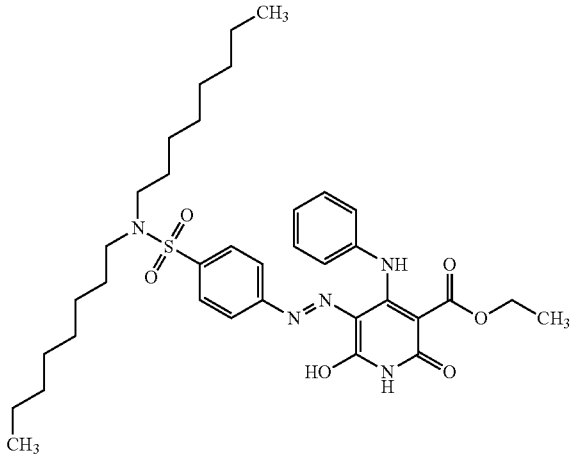
-continued
Compound (17)
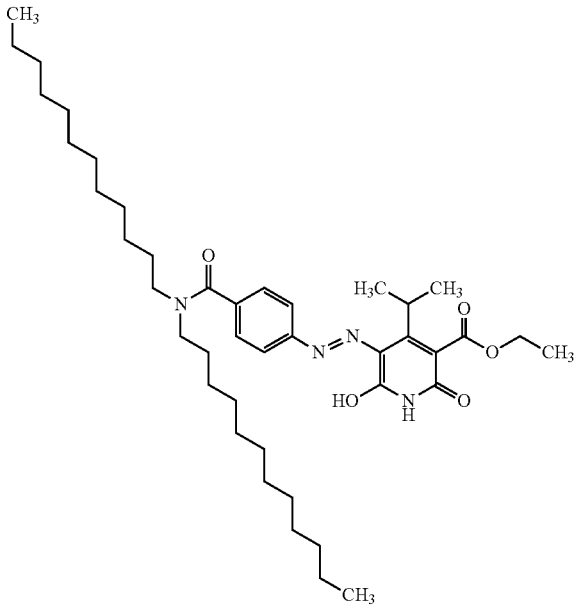
Compound (18)
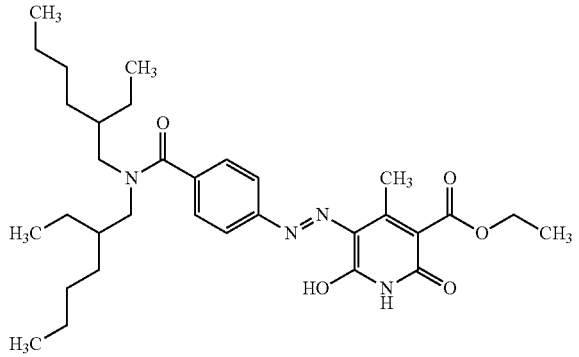
Compound (19)
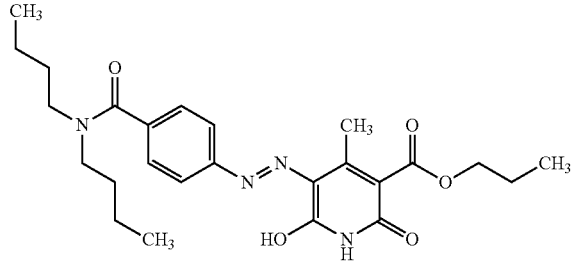

-continued
Compound (20)
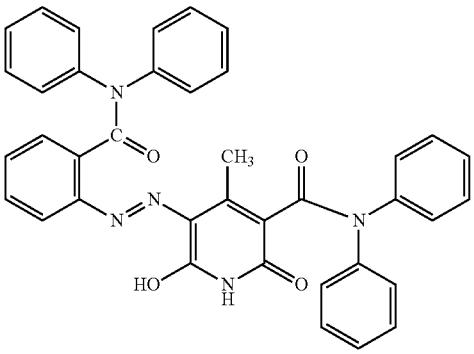
Compound (21)
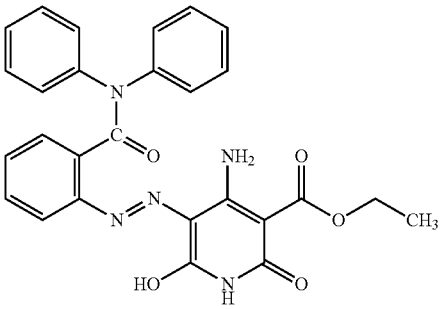
Compound (22)
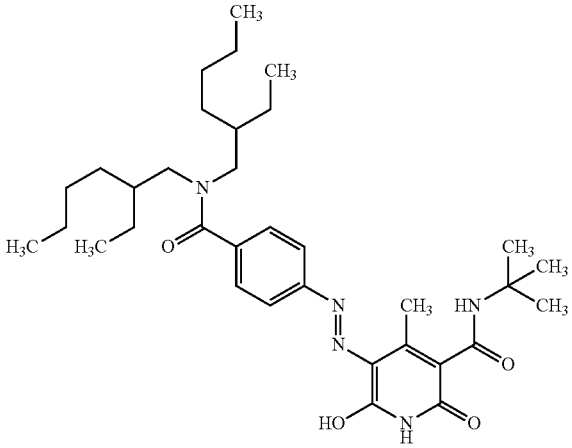
Compound (23)
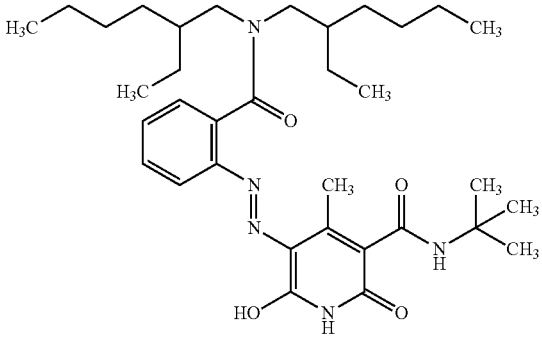
-continued
Compound (24)
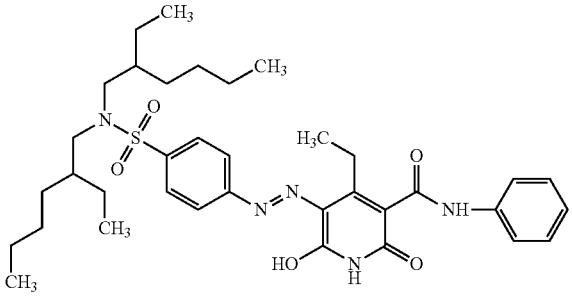
Compound (25)
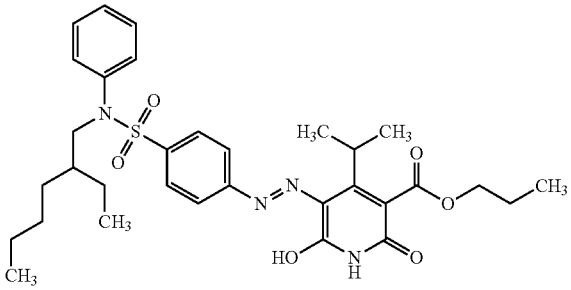
Compound (26)
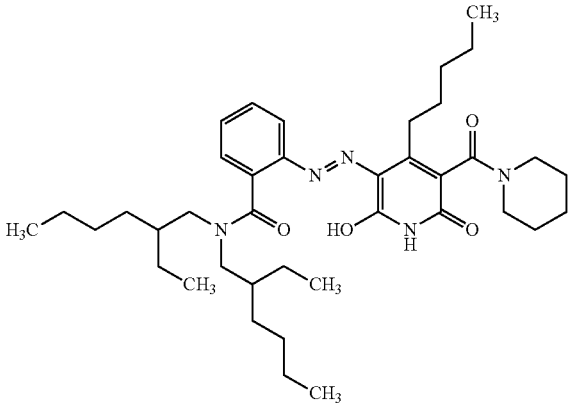
Compound (27)
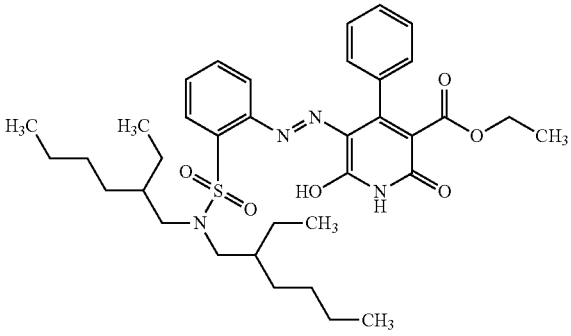

-continued

Compound (28)

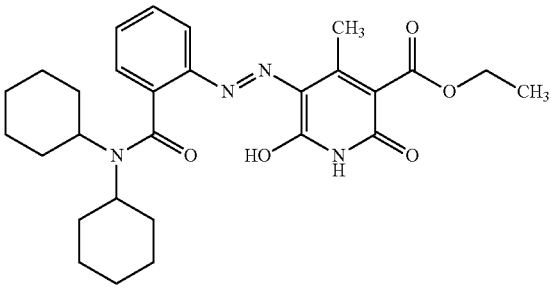

Among the above compounds, the compound (1), (4), (10), (11), (18), (19), (20), (23), (24), (26), (27), or (28) is preferable; and the compound (1), (4), (11), (18), (23), (26), or (28) is more preferable.

The content of a compound represented by the general formula (1) can be 1 to 20 parts by mass with respect to 100 parts by mass of a binder resin.

A compound used in the present invention and represented by the general formula (1) can be used singly or in combination with a known yellow dye in order to regulate the color tone according to production units for each toner.

A compound used in the present invention and represented by the general formula (1) may be used in combination with a usual yellow pigment. Particularly the use in combination with C.I. Pigment Yellow 185, C.I. Pigment Yellow 180, and C.I. Pigment Yellow 155 is effective for obtaining a good yellow color. These pigments may be used singly or as a mixture of two or more.

A compound represented by the general formula (1) can be synthesized by a known method.

When a toner is produced, a colorant may be used as a coloring matter dispersion in which the colorant is dispersed in a dispersion medium.

In the case of using a compound represented by the general formula (1) as a colorant, the increase in the viscosity when the colorant is dispersed in a dispersion medium can be suppressed. Accordingly, a prepared coloring matter dispersion is easy to handle in a mixing step and a granulation step, and a toner can be obtained in which the colorant is well dispersed and the particle size distribution is sharp.

The coloring matter dispersion will be described.

A dispersion medium used in the present invention refers to water, an organic solvent, or a mixture thereof.

The coloring matter dispersion is obtained by dispersing a dye compound represented by the general formula (1) in a dispersion medium. Specifically, the following method is included.

The dye compound represented by the general formula (1), and as required, a resin are dissolved in a dispersion medium, and well adapted to the dispersion medium under stirring. The dye compound can be finely dispersed stably in a state of uniform fine particles further by applying a mechanical shearing force with a dispersing machine such as a ball mill, a paint shaker, a dissolver, an attritor, a sand mill, or a high-speed mill.

In the present invention, the amount of a dye compound in a coloring matter dispersion is preferably 1.0 to 30 parts by mass, more preferably 2.0 to 20 parts by mass, and especially preferably 3.0 to 15 parts by mass, with respect to 100 parts by mass of the dispersion medium. With the content of the dye compound in the above-mentioned range, the viscosity can be increased and the dye compound dispersibility can further be improved, so that a good coloring power can be exhibited.

In the present invention, the coloring matter dispersion can be dispersed in water by using an emulsifying agent. For example, in the case where a coloring matter dispersion containing a resin is dispersed in water, a toner can be produced by a dissolution suspension method. Specific examples of the emulsifying agent include cationic surfactants, anionic surfactants, and nonionic surfactants. The cationic surfactant includes dodecylammonium chloride, dodecylammonium bromide, dodecyltrimethylammonium bromide, dodecylpyridinium chloride, dodecylpyridinium bromide, and hexadecyltrimethylammonium bromide.

The anionic surfactant includes fatty acid soaps such as sodium stearate and sodium dodecanoate, sodium dodecylsulfate, sodium dodecylbenzenesulfate, and sodium laurylsulfate.

The nonionic surfactant includes dodecyl polyoxyethylene ethers, hexadecyl polyoxyethylene ethers, nonylphenyl polyoxyethylene ethers, lauryl polyoxyethylene ethers, sorbitan-monooleate polyoxyethylene ethers, and monodecanoyl sucroses.

Organic solvents used as a dispersion medium include: alcohols such as methyl alcohol, ethyl alcohol, denatured ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, and cyclohexanol; glycols such as methyl cellosolve, ethyl cellosolve, diethylene glycol, and diethylene glycol monobutyl ether; ketones such as acetone, methyl ethyl ketone, and methyl isobutyl ketone; esters such as ethyl acetate, butyl acetate, ethyl propionate, and cellosolve acetate; hydrocarbon-based solvents such as hexane, octane, petroleum ethers, cyclohexane, benzene, toluene, and xylene; halogenated hydrocarbon-based solvents such as carbon tetrachloride, trichloroethylene, and tetrabromoethane; ethers such as diethyl ether, dimethyl glycol, trioxane, and tetrahydrofuran; acetals such as methylal and diethyl acetal; organic acids such as formic acid, acetic acid, and propionic acid; and sulfur or nitrogen-containing organic compounds such as nitrobenzene, dimethylamine, monoethanolamine, pyridine, dimethyl sulfoxide, and dimethylformamide.

In the case of producing toner particles by a suspension polymerization method, an organic solvent used in the present invention can be a polymerizable monomer. The polymerizable monomer is preferably an addition-polymerizable monomer or a condensation-polymerizable monomer, and more preferably an addition-polymerizable monomer. The polymerizable monomers specifically include styrene-based monomers such as styrene, o-methylstyrene, m-methylstyrene, p-methylstyrene, o-ethylstyrene, m-ethylstyrene, and p-ethylstyrene; acrylate-based monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylic acid amide; methacrylate-based monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylic acid amide; olefin-based monomers such as ethylene, propylene, butylene, butadiene, isoprene, isobutylene, and cyclohexene; halogenated vinyls such as vinyl chloride, vinylidene chloride, vinyl bromide, and vinyl iodide; vinyl esters such as vinyl acetate, vinyl propionate, and vinyl benzoate; vinyl ethers such as vinyl methyl ether, vinyl ethyl ether, and vinyl isobutyl ether; and vinyl ketone compounds such as vinyl methyl ketone, vinyl hexyl ketone, and methyl isopropenyl ketone. These may be used singly or in combination of two or more according to use applications. In the case of using the coloring matter dispersion according to the present invention for an application to a polymerized toner, among the above-mentioned polymerizable monomers, styrene or styrenic monomers are preferably used singly or as a mixture with other polymerizable monomers. Styrene is especially preferable because being easily handled.

A resin may further be added to the coloring matter dispersion. A resin usable for the coloring matter dispersion is determined according to the purpose and application, and is not especially limited. The resins specifically include polystyrene resins, styrene copolymers, polyacrylic acid resins, polymethacrylic acid resins, polyacrylate ester resins, polymethacrylate ester resins, acrylic acid-based copolymers, methacrylic acid-based copolymers, polyester resins, polyvinyl ether resins, polyvinyl methyl ether resins, polyvinyl alcohol resins, and polyvinyl butyral resins. These resins may be used singly or as a mixture of two or more.

<Binder Resins>

Binder resins used for the present invention are not especially limited, but examples thereof include thermoplastic resins.

The binder resins specifically include homopolymers or copolymers (styrene-based resins) of styrenes, such as styrene, parachlorostyrene, and α-methylstyrene; homopolymers or copolymers (acryl-based resins) of esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers (vinyl-based resins) of vinylnitriles, such as acrylonitrile and methacrylonitrile; homopolymers or copolymers (vinyl-based resins) of vinyl ethers, such as vinyl ethyl ether and vinyl isobutyl ether; homopolymers or copolymers (vinyl-based resins) of ketones, such as vinyl methyl ketone, vinyl ethyl ketone, and vinyl isopropenyl ketone; homopolymers or copolymers (olefin-based resins) of olefins, such as ethylene, propylene, butadiene, and isoprene; and non-vinyl condensed resins such as epoxy resins, polyester resins, polyurethane resins, polyamide resins, cellulosic resins, and polyether resins, and graft polymers of these non-vinyl condensed resins and vinylic monomers. These resins may be used singly or used concurrently in two or more.

The polyester resin is synthesized from a constituent (for example, dicarboxylic acid) originated from an acid and a constituent (for example, diol) originated from an alcohol. In the present invention, "a constituent originated from an acid" refers to a constituting site which was an acid component before the synthesis of the polyester resin, and "a constituent originated from an alcohol" refers to a constituting site which was an alcohol component before the synthesis of the polyester resin.

The constituent originated from an acid is not especially limited, but includes constituents originated from aliphatic dicarboxylic acids, constituents originated from dicarboxylic acids having a double bond, and constituents originated from dicarboxylic acids having a sulfonic acid group. The constituent originated from an acid specifically includes oxalic acid, malonic acid, succinic acid, glutaric acid, adipic acid, pimelic acid, suberic acid, azelaic acid, sebacic acid, 1,9-nonanedicarboxylic acid, 1,10-deccanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters and acid anhydrides thereof. Among these, constituents originated from aliphatic dicarboxylic acids are preferable, and that aliphatic sites in the aliphatic dicarboxylic acids are saturated carboxylic acids is more preferable.

The constituents originated from an alcohol are not especially limited, but are preferably aliphatic diols. Specific examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-deccanediol, 1,11-dodecanediol, 1,12-undecanediol, 1,13-tridecanediol, 1,14-tetradecanediol, 1,18-octadecanediol, and 1,20-eicosanediol.

A polyester-based resin used in the present invention is not especially limited, but is especially preferably a polyester-based resin in which the ratio in mol % of alcohol components/acid components is 45/55 to 55/45 in the total components. The polyester-based resin used in the present invention, as the number of terminal groups of the molecular chains increases, has larger environmental dependency in the toner charging property. Thus, the acid value is preferably 90 mgKOH/g or less, and more preferably 50 mgKOH/g or less. The hydroxyl value is preferably 50 mgKOH/g or less, and more preferably 30 mgKOH/g or less.

In the present invention, in order to raise the mechanical strength of a toner particle and control the molecular weight of a toner molecule, a crosslinking agent may be used in the synthesis of a binder resin.

The crosslinking agent used for the toner of the present invention is not especially limited, but specific examples thereof include, as bifunctional crosslinking agents, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylates, polyester-type diacrylates, and dimethacrylates corresponding to the above diacrylates.

The polyfunctional crosslinking agent is not especially limited, but specific examples thereof include pentaerythritol triacrylate, trimethylolethane triacrylate, trimethylolpropane triacrylate, tetramethylolmethane tetraacrylate, acrylates of oligoesters, methacrylates of the oligoesters, 2,2-bis(4-methacryloxyphenyl)propane, diallyl phthalate, triallyl cyanurate, triallyl isocyanurate, and triallyl trimellitate.

The content of a crosslinking agent used can be preferably 0.05 to 10 parts by mass, and is more preferably 0.1 to 5 parts by mass, with respect to 100 parts by mass of the above monomer.

The glass transition temperature of the binder resin is preferably 45 to 80° C., and more preferably 55 to 70° C. The number-average molecular weight (Mn) of the binder resin can be 2,500 to 50,000. The weight-average molecular weight (Mw) of the binder resin can be 10,000 to 1,000,000.

<Wax>

A toner particle may contain a wax.

Wax which can be used in the present invention is not especially limited. Specific examples thereof are as follows.

Paraffin waxes, microcrystalline waxes, petroleum-based waxes such as petrolatums and derivatives thereof.

Montan waxes and derivatives thereof.

Hydrocarbon waxes by Fischer-Tropsch process and derivatives thereof.

Polyolefin waxes represented by polyethylenes, and derivatives thereof.

Natural waxes such as carnauba waxes and candelilla waxes, and derivatives thereof, and the like. Here, the derivative includes oxides, block copolymers with a vinyl monomer, and graft modified materials as well. The wax components also include alcohols such as higher aliphatic alcohols; aliphatic acids such as stearic acid and palmitic acid and acid amides, esters, or ketones thereof; hardened castor oils and derivatives thereof; plant waxes; and animal waxes. These can be used singly or used concurrently in two or more.

The total amount of a wax added is preferably in the range of 2.5 to 15.0 parts by mass, and more preferably in the range of 3.0 to 10.0 parts by mass, with respect to 100 parts by mass of a binder resin. Regulation of the amount of a wax added in the above-mentioned range allows to facilitate oilless fixation and to suppress the influence on the charging property lower.

A wax used in the present invention preferably has a melting point of 50° C. or more and 200° C. or less, and more preferably 55° C. or more and 150° C. or less. In the case where the melting point of a wax is 50° C. or more and 200° C. or less, the blocking resistance of a toner is further improved; further the bleeding of the wax in fixation is improved; and the peelability in oilless fixation is also improved.

The melting point in the present invention refers to a peak temperature of the maximum endothermic peak in a differential scanning calorimetry (DSC) curve measured according to ASTM D3418-82. Specifically, a DSC curve is acquired by using a differential scanning calorimeter, setting a measurement temperature range from 30 to 200° C. and a temperature-rise rate at 5° C./min, and acquiring the DSC curve in the temperature range of 30 to 200° C. in a second temperature-rise process in the normal temperature and normal humidity environment. The peak temperature of the maximum endothermic peak in the acquired DSC curve is defined as a melting point. DSC822 made by Mettler Toledo International Inc. was used as the differential scanning calorimeter.

<Other Toner Constituting Materials>

The toner according to the present invention, as required, may contain a charge control agent. In this case, the control of a frictional charging amount which is optimum according to a development system is allowed to be facilitated.

As the charge control agent, a conventionally known agent can be utilized, and in particular, a charge control agent exhibiting a high charging speed and being capable of stably maintaining a certain charge amount is preferable. Further in the case where a toner is produced directly by a polymerization method, a charge control agent exhibiting low polymerization inhibition and having substantially no materials soluble to an aqueous dispersion medium is especially preferable.

The charge control agent includes a charge control agent having a negatively charging property to control a toner so as to be negatively chargeable, and a charge control agent having a positively charging property to control a toner so as to be positively chargeable.

The charge control agent having a negatively charging property includes polymers or copolymers having a sulfonic acid group, a sulfonic acid base, or an alkoxysulfonyl group, salicylic acid derivatives and metal complexes thereof, monoazo metal compounds, aromatic oxycarboxylic acids and metal salts thereof, and resin-based charge control agents.

The examples of charge control agent having a positively charging property include nigrosins and nigrosins modified with fatty acid metal salts, guanidine compounds, imidazole compounds, tributylbenzylammonium-1-hydroxy-4-naphthosulfonate salts, quaternary ammonium salts such as tetrabutylammonium tetrafluoroborate, onium salts such as phosphonium salts, which are analogs of the quaternary ammonium salts, and lake pigments thereof, triphenylmethane dyes and lake pigments thereof (laking agents include tungstophosphoric acid, molybdophosphoric acid, tungstomolybdophosphoric acid, tannic acid, lauric acid, gallic acid, ferricyanidated substances, and ferrocyanidated substances), metal salts of higher fatty acids, diorganotin oxides such as dibutyltin oxide, dioctyltin oxide, and dicyclohexyltin oxide, diorganotin borates such as dibutyltin borate, dioctyltin borate, and dicyclohexyltin borate, and resin-based charge control agents. These charge control agents may be used singly or in combination of two or more.

In the yellow toner according to the present invention, an inorganic fine powder and a resin particle may be externally added to a toner particle. The inorganic fine powder includes fine powders of silica, titanium oxide, alumina, and double oxides thereof, and surface-treated fine powders thereof. The resin particle includes resin particles of vinylic resins, polyester resins, and silicone resins. These inorganic fine powders and resin particles are external additives having functions as a fluidity auxiliary agent and a washing auxiliary agent.

Methods for producing toner particles will be described hereinafter, but the present invention is not limited to these production methods.

The methods for producing the toner particles include a pulverization method, a suspension polymerization method, a suspension granulation method, an emulsion polymerization method, and an emulsion aggregation method.

The toner particles of the present invention may be used for a developer (hereinafter, referred to as a liquid developer) used in the liquid development method. Among these, the toner particle is preferably toner particles produced by a suspension polymerization method.

<A Method for Producing Toner Particles by a Suspension Polymerization Method>

In a suspension polymerization method, toner particles are produced through a granulation step of adding a polymerizable monomer composition containing a colorant, a polymerizable monomer, and a polymerization initiator to an aqueous medium, and granulating the polymerizable monomer composition in the aqueous medium to thereby form a particle of the polymerizable monomer composition, and a polymerization step of polymerizing the polymerizable monomer contained in the particle of the polymerizable monomer composition. As required, the polymerizable monomer composition may further contain a wax.

The polymerizable monomer composition in the above-mentioned step can be a polymerizable monomer composition prepared by mixing a dispersion liquid (coloring matter dispersion) in which the colorant is dispersed in a first polymerizable monomer, with a second polymerizable monomer. That is, by sufficiently dispersing the colorant in a first polymerizable monomer, and thereafter mixing the dispersion liquid with a second polymerizable monomer together with other toner materials, the colorant is allowed to be present in a better dispersing state in a toner particle. Here, the first polymerizable monomer and the second polymerizable monomer may be the same or different polymerizable monomers.

A polymerization initiator used in the suspension polymerization method includes known polymerization initiators.

Specific examples thereof include azo compounds, organic peroxides, inorganic peroxides, organometal compounds, and photopolymerization initiators. More specific examples thereof include azo-based polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis(isobutyrate), organic peroxide-based polymerization initiators such as benzoyl peroxide, di-tert-butyl peroxide, tert-butylperoxyisopropyl monocarbonate, tert-hexylperoxybenzoate, and tert-butylperoxybenzoate, inorganic peroxide-based polymerization initiators such as potassium persulfate and ammonium persulfate, redox initiators such as combinations of hydrogen peroxide and a ferrous salt, BPO and dimethylaniline, and a cerium (IV) salt and an alcohol. The photopolymerization initiator includes acetophenone-based, benzoin ether-based, and ketal-based photopolymerization initiators. These methods can be used singly or in combination of two or more.

The amount of the above polymerization initiator added can be in the range of 0.1 to 20 parts by mass, and is more preferably in the range of 0.1 to 10 parts by mass, with respect to 100 parts by mass of the polymerizable monomer. The kind of the above polymerization initiator slightly depends on polymerization methods, but is used singly or as a mixture of two or more kinds by reference to their 10-hour half-life temperature.

Preferably, a dispersion stabilizer is incorporated into an aqueous medium used in the above suspension polymerization method. As the dispersion stabilizer, known inorganic and organic dispersion stabilizers can be used. Examples of the inorganic dispersion stabilizers include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizers include polyvinyl alcohols, gelatins, methyl celluloses, methyl hydroxypropyl celluloses, ethyl celluloses, sodium salts of carboxymethyl celluloses, and starches. Nonionic, anionic, and cationic surfactants also can be utilized. Specific examples thereof include sodium dodecylsulfate, sodium tetradecylsulfate, sodium pentadecylsulfate, sodium octylsulfate, sodium oleate, sodium laurate, potassium stearate, and calcium oleate.

In the present invention, among the above dispersion stabilizers, poorly water-soluble inorganic dispersion stabilizers soluble to acids can preferably be used. In the case where an aqueous dispersion medium is prepared using a poorly water-soluble inorganic dispersion stabilizer, the dispersion stabilizer can be used in a ratio of 0.2 to 2.0 parts by mass with respect to 100 parts by mass of a polymerizable monomer in the point of the droplet stability of the polymerizable monomer composition in an aqueous medium. Further in the present invention, the aqueous medium can be prepared using water in the range of 300 to 3,000 parts by mass with respect to 100 parts by mass of the polymerizable monomer composition.

In the present invention, in the case of preparing an aqueous medium in which the above-mentioned poorly water-soluble inorganic dispersion stabilizer is dispersed, the dispersing may be carried out using a commercially available dispersion stabilizer as it is. In order to obtain dispersion stabilizer particles having a fine uniform particle size, the dispersion stabilizer particles can be prepared by forming the above poorly water-soluble inorganic dispersion stabilizer under high-speed stirring in water. For example, in the case of using calcium phosphate as a dispersion stabilizer, a sodium phosphate aqueous solution and a calcium chloride aqueous solution are mixed under high-speed stirring to thereby obtain fine particles of calcium phosphate, whereby a preferable dispersion stabilizer can be obtained.

<Production Method of Toner Particles by a Suspension Granulation Method>

Toner particles contained in the toner according to the present invention may be particles produced by a suspension granulation method. Since the suspension granulation method has no heating step, the compatibilization of a resin with a wax component, which would be caused in the case of using a low-melting point wax, can be suppressed and the decrease of the glass transition temperature of the toner caused by the compatibilization can be prevented. The suspension granulation method has a broad option of the toner material to be binder resins; and it is thereby easy to use a polyester resin, which is generally said to be advantageous for fixability, as a main component. Thus, the suspension granulation method is a production method advantageous in the case where a toner of a resin composition to which the suspension polymerization method cannot be applied is produced.

The toner particles produced by the above suspension granulation method are produced as follows.

First, a colorant, a binder resin, a wax are mixed in a solvent to thereby prepare a solvent composition. Then, the solvent composition is dispersed in an aqueous medium to granulate particles of the solvent composition to thereby obtain a toner particle suspension liquid. Then, the obtained suspension liquid is heated or depressurized to remove the solvent to thereby obtain a toner particle.

The solvent composition in the above-mentioned step can be a solvent composition prepared by mixing a dispersion liquid in which the colorant is dispersed in a first solvent, with a second solvent. That is, by sufficiently dispersing a colorant in a first solvent, and thereafter mixing the dispersion liquid with a second solvent together with other toner materials, the colorant is allowed to be present in a better dispersing state in a toner particle.

Examples of solvents usable in the above suspension granulation method include hydrocarbons such as toluene, xylene, and hexane, halogen-containing hydrocarbons such as methylene chloride, chloroform, dichloroethane, trichloroethane, and carbon tetrachloride, alcohols such as methanol, ethanol, butanol, and isopropyl alcohol, polyhydric alcohols such as ethylene glycol, propylene glycol, diethylene glycol, and triethylene glycol, cellosolves such as methyl cellosolve and ethyl cellosolve, ketones such as acetone, methyl ethyl ketone, and methyl isobutyl ketone, ethers such as benzyl alcohol ethyl ether, benzyl alcohol isopropyl ether, and tetrahydrofuran, and esters such as methyl acetate, ethyl acetate, and butyl acetate. These may be used singly or as a mixture of two or more. Among these, solvents can be used which have a low boiling point in order to easily remove the solvent in the above toner particle suspension liquid and can sufficiently dissolve the above binder resin.

The amount of the above solvent is preferably in the range of 50 to 5,000 parts by mass, and is more preferably in the range of 120 to 1,000 parts by mass, with respect to 100 parts by mass of the binder resin. An aqueous medium used in the above suspension granulation method can contain a dispersion stabilizer. The dispersion stabilizer usable can be the same as used in the suspension polymerization method. The amount of the above dispersion stabilizer used is preferably in the range of 0.01 to 20 parts by mass with respect to 100 parts by mass of the binder resin from the viewpoint of the liquid droplet stability in an aqueous medium of the solvent composition.

<A Method for Producing Toner Particles by a Pulverization Method>

A toner by a pulverization method can be produced using a known production apparatus such as a mixing machine, a heat kneading machine, and a classifying machine.

First, a binder resin and a colorant, and as required, a wax, a charge control agent and other materials are sufficiently mixed by a mixing machine such as a HENSCHEL mixer or a ball mill. Then, the mixture is melted using a heat kneading machine such as a roll, a kneader, or an extruder. The mixture is further kneaded to mutually compatibilize the resins to thereby disperse the wax or the like in the compatibilized resins. The obtained dispersion melt is, after being cooled and solidified, pulverized and classified, whereby the toner can be obtained.

These binder resins may be used singly, or concurrently in two or more.

In the case of mixing and using two or more kinds of the resins, the resins having different molecular weights can be mixed in order to control the viscoelastic property of the toner.

<Production of Toner Particles by an Emulsion Aggregation Method>

Then, the production method of toner particles by an emulsion aggregation method will be described.

First, a resin particle dispersion liquid, a colorant particle dispersion liquid, and dispersion liquids of other necessary toner components (for example, a wax dispersion liquid) are prepared. The each dispersion liquid contains a dispersoid and an aqueous medium, and the aqueous medium means a medium containing water as a major component. Examples of the aqueous medium include water itself, a water having a pH regulator added thereto, and a water having an organic solvent added thereto.

Toner particles are obtained through a step (aggregation step) of aggregating particles contained in a mixed liquid of the each dispersion liquid to thereby form an aggregate particle, a heating and fusing step (fusing step) of heating and fusing the aggregate particle, a washing step, and a drying step.

A dispersant such as a surfactant may be added to the each particle dispersion liquid. The colorant particle is dispersed by a known method, but a rotation shearing-type homogenizer, a media-type dispersing machine such as a ball mill, a sand mill, or an attritor, or a high-pressure counter collision type dispersing machine can be used.

The surfactant includes water-soluble polymers, inorganic compounds, and ionic or nonionic surfactants. The ionic surfactants exhibiting high dispersibility are preferably used particularly because of the problem with dispersibility, and anionic surfactants are particularly preferably used. Further, the molecular weight of the above surfactant is preferably 100 to 10,000, and is more preferably 200 to 5,000, from the viewpoint of the washability and surface activity.

Specific examples of the surfactants include water-soluble polymers such as polyvinyl alcohols, methyl celluloses, carboxymethyl celluloses, and sodium polyacrylates; anionic surfactants such as sodium dodecylbenzenesulfonate, sodium octadecylsulfate, sodium oleate, sodium laurate, and potassium stearate; cationic surfactants such as laurylamine acetate and lauryltrimethylammonium chloride, amphoteric ionic surfactants such as lauryldimethylamine oxide; nonionic surfactants such as polyoxyethylene alkyl ethers, polyoxyethylene alkyl phenyl ethers, and polyoxyethylene alkylamines; and inorganic compounds such as tricalcium phosphate, aluminum hydroxide, calcium sulfate, calcium carbonate, and barium carbonate.

These may be used singly or as required, used in combination of two or more.

(Wax Dispersion Liquid)

A wax dispersion liquid is prepared by dispersing a wax in an aqueous medium. The wax dispersion liquid is prepared by a known method. Here, the above-mentioned wax can be used as a wax.

(Resin Particle Dispersion Liquid)

A resin particle dispersion liquid is made by dispersing a resin particle in an aqueous medium.

In the present invention, an aqueous medium means a medium having water as a major component. Specific examples of the aqueous medium include water itself, a water having a pH regulator added therein, and a water having an organic solvent added therein.

As a resin constituting a resin particle contained in the resin particle dispersion liquid, the resin exemplified as a binder resin can be used. A resin particle dispersion liquid used in the present invention is prepared by dispersing the resin particle in an aqueous medium. The above resin particle dispersion liquid is prepared by a known method. For example, in the case of a resin particle dispersion liquid containing a resin particle having a vinylic monomer, particularly a styrenic monomer, as a constituent, the resin particle dispersion liquid can be prepared by emulsion-polymerizing the monomer using a surfactant and the like.

In the case of a resin (for example, a polyester resin) fabricated by another method, the resin is dispersed in water together with an ionic surfactant and a polymeric electrolyte by a dispersing machine such as a homogenizer. A resin particle dispersion liquid can be prepared by thereafter evaporating the solvent. Alternatively, there is a method in which a surfactant is added to a resin and the resin is emulsified and dispersed in water by using a dispersing machine such as a homogenizer, or a resin particle dispersion liquid may be prepared by a phase inversion emulsion method or the like.

The median diameter in terms of volume of the resin particle in the resin particle dispersion liquid can be 0.005 to 1.0 μm, and is more preferably 0.01 to 0.4 μm. The satisfaction of the above range of the median diameter in terms of volume by the resin particle provides more easily a toner having an adequate particle diameter.

The average particle diameter of resin particles can be measured by a measurement method such as a dynamic light scattering method (DLS), a laser scattering method, a centrifugal settlement method, a field-flow fractionation method, or an electric sensing zone method. Here, in the present invention, the average particle diameter of the resin particles means a 50%-cumulative particle diameter value (D50) in terms of volume measured by a dynamic light scattering method (DLS)/a laser Doppler method at 20° C. in a solid content concentration of 0.01% by mass as described later unless otherwise specified.

(A Colorant Particle Dispersion Liquid)

A colorant particle dispersion liquid is prepared by dispersing a colorant together with a surfactant in an aqueous medium.

First, a compound represented by the general formula (1) according to the present invention is prepared as a dispersion liquid. Also a mixture of a compound represented by the general formula (1) can be prepared as a dispersion liquid. The colorant particle is dispersed by a known method, that is, a rotary shearing homogenizer, a media-type dispersing machine such as a ball mill, a sand mill, or an attritor, and a high-pressure counter collision-type dispersing machine can be used.

The amount of a surfactant used is preferably 0.01 to 10 parts by mass, more preferably 0.1 to 5.0 parts by mass, and still more preferably 0.5 part by mass to 3.0 parts by mass, with respect to 100 parts by mass of a colorant, from the viewpoint of easy removal of the surfactant in a toner. As a result, the amount of the surfactant remaining in the toner obtained becomes small, and effects of increasing the image density due to the toner and hardly generating fogging can be provided.

[Aggregation Step]

A method for forming an aggregate particle is not especially limited, but a suitable example thereof is a method in which a pH regulator, an aggregating agent, a stabilizer are added to and mixed with the above mixed liquid, and a temperature, a mechanical power (stirring) are suitably applied to the mixture.

The pH regulator is not especially limited, but includes alkalis such as ammonia and sodium hydroxide, and acids such as nitric acid and citric acid.

The aggregating agent is not especially limited, but includes inorganic metal salts such as sodium chloride, magnesium carbonate, magnesium chloride, magnesium nitrate, magnesium sulfate, calcium chloride, and aluminum sulfate, and additionally, di- or more polyvalent metal complexes.

The stabilizer mainly includes surfactants.

The surfactant is not especially limited, but includes water-soluble polymers such as polyvinyl alcohols, methyl celluloses, carboxymethyl celluloses, and sodium polyacrylates; anionic surfactants such as sodium dodecylbenzenesulfonate, sodium octadecylsulfate, sodium oleate, sodium laurate, and potassium stearate; cationic surfactants such as laurylamine acetate and lauryltrimethylammonium chloride, amphoteric ionic surfactants such as lauryldimethylamine oxide; non-ionic surfactants such as polyoxyethylene alkyl ethers, polyoxyethylene alkyl phenyl ethers, and polyoxyethylene alkylamines; and inorganic compounds such as tricalcium phosphate, aluminum hydroxide, calcium sulfate, calcium carbonate, and barium carbonate. These may be used singly or as required, used in combination of two or more.

The average particle diameter of the aggregate particles formed here is not especially limited, but may usually be controlled so as to become nearly equal to the average particle diameter of toner particles to be obtained. The control can easily be carried out by suitably setting and changing the temperature in the addition and mixing and the conditions of the above stirring and mixing of the above aggregating agent and the like. Further in order to reduce fusing among toner particles, the above pH regulator, the above surfactant can suitably be charged.

[Fusing Step]

In the fusing step, the above aggregate particles are heated and fused to thereby form toner particles.

The heating temperature may be between the glass transition temperature (Tg) of the resin contained in the aggregate particle and the decomposition temperature of the resin. Under stirring similar in the aggregation step, by addition of a surfactant, regulation of pH, the progress of aggregation is stopped; and by heating at a temperature higher than the glass transition temperature of the resin in the resin particle, the aggregate particles are caused to fuse and coalesce.

The heating time may be in a level carrying out the fusing sufficiently, and may specifically be about 10 min to 10 hours.

Before or after the fusing step, further a step (adhesion step) can be included in which a fine particle dispersion liquid containing fine particles dispersed therein is added and mixed to cause the fine particles to adhere on the above aggregate particle to thereby form a core-shell structure.

[Washing Step]

The toner particles obtained after the fusing step are washed, filtered, dried under appropriate conditions to thereby obtain a toner particle. In this case, in order to secure the charging property and reliability sufficient as a toner, the toner particle can be washed sufficiently.

A washing method is not limited, but the washing can be carried out by filtering a suspension liquid containing toner particles, stirring and washing the obtained filtrand by using distilled water, and further filtering the resultant. The washing is repeated until the electroconductivity of the filtrate becomes 150 μS/cm or less, from the viewpoint of the chargeability of a toner. Making the electroconductivity of the filtrate to be 150 μS/cm or less can suppress the decrease of the charging property of the toner, and consequently can suppress fogging occurrence and further improve the image density.

[Drying Step]

Drying can utilize a known method such as a conventional vibration fluidized drying method, a spray dry method, a freeze-drying method or a flash jet method. The moisture content of the toner particles after the drying is preferably 1.5% by mass or less, and is more preferably 1.0% by mass or less.

The yellow toner according to the present invention preferably has a weight-average particle diameter (D4) of 4.0 to 9.0 μm, and more preferably 4.9 to 7.5 μm. Satisfaction of the above range of the weight-average particle diameter (D4) by the yellow toner improves the charging stability, and hardly generates image fogging and development streaks in the continuous developing operation (durability operation) of a large number of sheets. Also the reproducibility of halftone portions is more improved.

In the yellow toner of the present invention, the ratio of the weight-average particle diameter (D4) to the number-average particle diameter (D1) (hereinafter, also referred to as weight-average particle diameter (D4)/number-average particle diameter (D1), or D4/D1) is preferably 1.35 or less, more preferably, 1.30 or less. Satisfaction of the above relation by the yellow toner suppresses fogging occurrence and improves transferability, and makes the thickness of the line width more uniform.

A regulation method for the weight-average particle diameter (D4) and the number-average particle diameter (D1) of the yellow toner of the present invention depends on a production method of toner particles. For example, in the case of the suspension polymerization method, the regulation can be carried out by controlling the dispersant concentration used in the preparation of an aqueous dispersion medium, the reaction stirring speed, the reaction stirring time, and the like.

The average degree of circularity of the yellow toner according to the present invention as measured by a flow-type particle image analyzer is preferably 0.930 or more and 0.995 or less, and more preferably 0.960 or more and 0.990 or less, from the viewpoint of large improvement of the toner transferability.

The toner according to the present invention may also be used for a developer used in a liquid developing method (hereinafter, also referred to as a liquid developer).

<Production Method of a Liquid Developer>

Hereinafter, a production method of a liquid developer will be described.

First, in order to obtain a liquid developer, a toner is dispersed or dissolved in an electrically insulating carrier liquid. As required, a charge control agent and a wax can be further dispersed or dissolved. Alternatively, a liquid developer may be prepared by a two-stage method in which a concentrated toner is fabricated first, and further diluted with an electrically insulating carrier liquid to thereby prepare the developer.

A dispersing machine used in the present invention is not especially limited, but for example, a rotary shearing homogenizer, a media-type dispersing machine such as a ball mill, a sand mill, or an attritor, and a high-pressure counter collision-type dispersing machine can be used.

To a toner of the present invention, further a known colorant such as a pigment or a dye may be added singly or in combination of two or more.

A wax and a colorant used in the present invention are similar to the above.

A charge control agent used in the present invention is not especially limited as long as being a charge control agent used for liquid developers for electrostatic charge development, but examples thereof include cobalt naphthenate, copper naphthenate, copper oleate, cobalt oleate, zirconium octoate, cobalt octoate, sodium dodecylbenzenesulfonate, calcium dodecylbenzenesulfonate, soy lecithin, and aluminum octoate.

An electrically insulating carrier liquid used in the present invention is not especially limited, but for example, an organic solvent having a high electric resistance of $10^9$ Ω·cm or more and a low permittivity of 3 or less can be used.

As specific examples thereof, organic solvents having a boiling point in the temperature range of 68 to 250° C. can be used, including aliphatic hydrocarbon solvents such as hexane, pentane, octane, nonane, decane, undecane, and dodecane, ISOPAR H, G, K, L, and M (made by ExxonMobile Chemicals Co.), and Linearen Dimer A-20 and A-20H (made by Idemitsu Kosan Co., Ltd.). These may be used singly or concurrently in two or more in the range in which the viscosity of the system does not rise.

EXAMPLES

Hereinafter, the present invention will be described in more detail by way of Examples and Comparative Examples, but the present invention is not limited to these Examples. "Parts" and "%" in the description are in terms of mass unless otherwise specified. The identification of an obtained reaction product was carried out by a plurality of analysis methods using apparatuses described below. That is, the apparatuses used were a $^1$H nuclear magnetic resonance spectrometer (ECA-400, made by JEOL Ltd.) and a MALDI MS (AutoFlex, made by Bruker Daltonics GmbH). Here, the MALDI MS employed the negative ion mode detection.

Production Example 1

Production of a Compound (1)

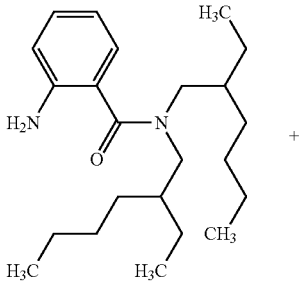

Amine compound (1)

-continued

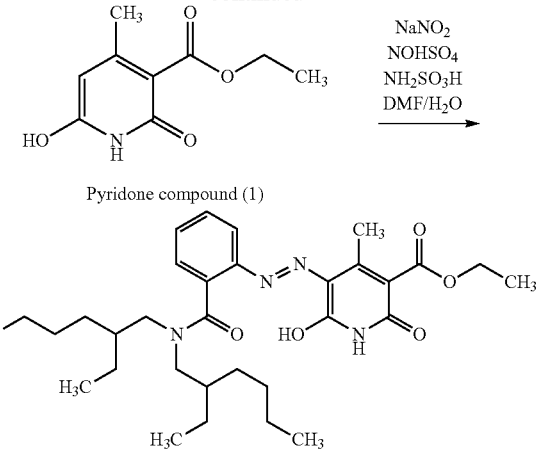

Pyridone compound (1)

Compound (1)

20 mL of an N,N-dimethylformamide solution of 3.00 g of an amine compound (1) was cooled to 5° C., and 20 mL of an N,N-dimethylformamide solution of 4.05 g of a 40% nitrosylsulfuric acid was slowly dropped. 3 mL of an aqueous solution of 0.63 g of sodium nitrite was dropped thereto, and stirred for 1 hour; and thereafter, 0.13 g of amidosulfuric acid was added to decompose excess nitrosylsulfuric acid to thereby obtain a diazotized A liquid. Separately, 8 mL of a dimethylformamide solution of 1.64 g of a pyridone compound (1) was cooled to 5° C.; and the diazotized A liquid was slowly dropped thereto so that the temperature was held at 5° C. or less, and further stirred at 0 to 5° C. for 2 hours. After the completion of the reaction, chloroform extraction was carried out. A chloroform layer was concentrated, and an obtained solid was refined by column chromatography (developing solvent: heptane/chloroform), and further recrystallized with a heptane/chloroform solution to thereby obtain 3.55 g of a compound (1).

[The analysis result of the compound (1)]

[1] $^1$H-NMR (400 MHz, $CDCl_3$, room temperature): δ [ppm]=0.59-0.67 (3H, m), 0.72-0.79 (3H, m), 0.88-1.16 (14H, m), 1.27-1.45 (11H, m), 1.68-1.89 (2H, m), 2.37 (3H, s), 3.24 (2H, d, J=6.10 Hz), 3.35-3.71 (2H, m), 4.41 (2H, q, J=7.12 Hz), 7.20 (1H, dd, J=7.63 Hz, 7.63 Hz), 7.26 (1H, d, J=7.63 Hz), 7.46 (1H, dd, J=7.63 Hz, 7.63 Hz), 7.84 (1H, d, J=7.63 Hz), 8.14 (1H, s), 14.74 (1H, s)

[2] mass spectrometry: m/z=567.783 $(M-H)^-$

Production Example 2

Production of a Compound (4)

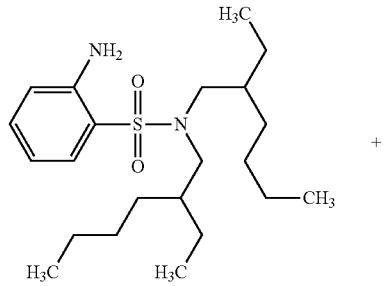

Amine compound (2)

-continued

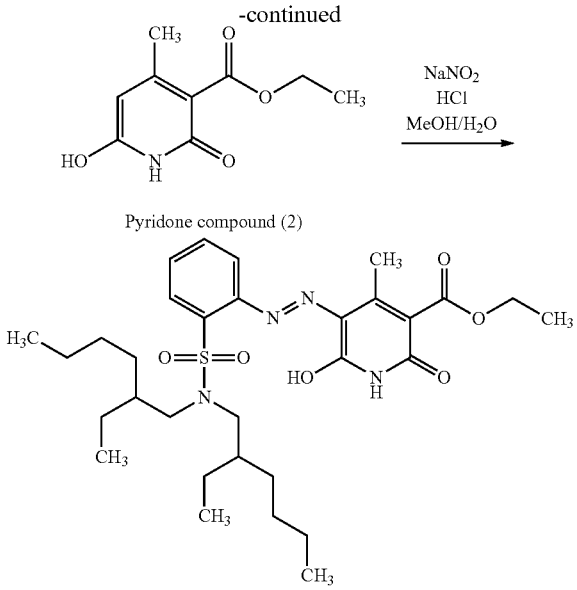

Pyridone compound (2)

Compound (4)

10 mL of a methanol solution of 3.00 g of an amine compound (2) was cooled to 5° C., and 1.3 mL of a 35% hydrochloric acid was dropped therein. 3 mL of an aqueous solution of 0.58 g of sodium nitrite was dropped therein, and stirred for 1 hour, and thereafter, 0.09 g of amidosulfuric acid was added thereto to decompose excess sodium nitrite to thereby obtain a diazotized B liquid. Separately, 10 mL of a methanol solution of 1.49 g of a pyridone compound (2) was cooled to 5° C., and the diazotized B liquid was slowly dropped therein so that the temperature was held at 5° C. or less, and further stirred at 0 to 5° C. for 1 hour. After the completion of the reaction, a sodium carbonate aqueous solution was dropped to neutralize the pH to 6; and thereafter, a deposited solid was filtered, and further washed with water. An obtained solid was refined by column chromatography (developing solvent: chloroform/methanol), and further recrystallized with a heptane solution to thereby obtain 3.0 g of a compound (4).

[The analysis result of the compound (4)]

[1] $^1$H NMR (400 MHz, $CDCl_3$, room temperature): δ [ppm]=0.74-0.87 (14H, m), 1.03-1.43 (21H, m), 2.32 (3H, s), 2.98-3.21 (4H, m), 7.23 (1H, t, J=7.63 Hz), 7.58 (1H, dd, J=7.63 Hz, 7.63 Hz), 7.84 (1H, d, J=7.63 Hz), 7.93 (1H, d, J=7.63 Hz), 8.14 (1H, br), 14.63 (1H, s)

[2] mass spectrometry: m/z=603.451 $(M-H)^-$

Production Example 3

Production of a Compound (23)

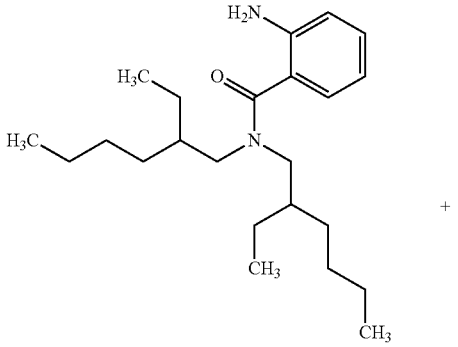

Amine compound (3)

-continued

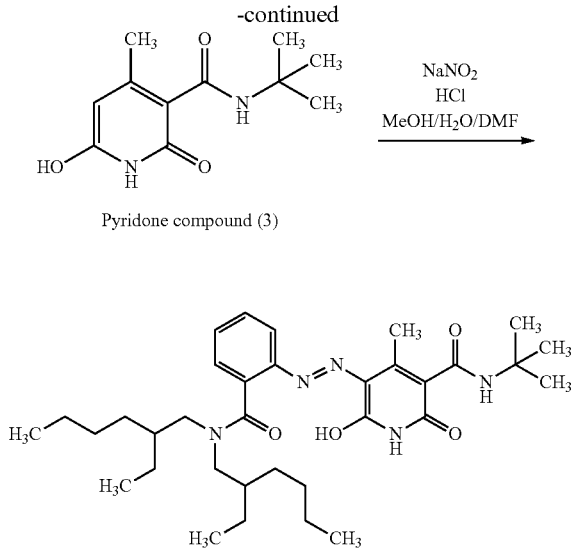

Pyridone compound (3)

Compound (23)

20 mL of a methanol solution of 3.0 g of an amine compound (3) was cooled to 5° C., and 1.5 mL of a 35% hydrochloric acid was dropped. 3 mL of an aqueous solution of 0.63 g of sodium nitrite was dropped thereto, and stirred for 1 hour; and thereafter, 0.10 g of amidosulfuric acid was added to decompose excess sodium nitrite to thereby obtain a diazotized C liquid. Separately, 8 mL of a dimethylformamide solution of 1.87 g of a pyridone compound (3) was cooled to 5° C.; and the diazotized C liquid was slowly dropped thereto so that the temperature was held at 5° C. or less, and further stirred at 0 to 5° C. for 3 hours. After the completion of the reaction, a sodium carbonate aqueous solution was dropped to neutralize the pH to 6, and thereafter, chloroform extraction was carried out. A chloroform layer was concentrated, and an obtained solid was refined by column chromatography (developing solvent: chloroform/methanol), and further recrystallized with a heptane/chloroform solution to thereby obtain 4.3 g of a compound (23).

[The analysis result of the compound (23)]

[1] $^1$H-NMR (400 MHz, $CDCl_3$, room temperature): δ [ppm]=0.57-0.67 (3H, m), 0.69-0.79 (3H, m), 0.84-1.18 (14H, m), 1.27-1.48 (17H, m), 1.74-1.94 (2H, m), 2.55 (3H, s), 3.24 (2H, d, J=6.10 Hz), 3.35-3.69 (2H, m), 6.81 (1H, s), 7.20 (1H, dd, J=7.63 Hz, 7.63 Hz), 7.26 (1H, d, J=7.63 Hz), 7.47 (1H, dd, J=7.63 Hz, 7.63 Hz), 7.85 (1H, d, J=7.63 Hz), 8.21 (1H, br), 14.78 (1H, s)

[2] mass spectrometry: m/z=594.530 $(M-H)^-$

Production Example 4

Production of a Compound (11)

A compound (11) was obtained by the same operation as in Production Example 2, except for altering the amine compound (2) and the pyridone compound (2) to the following amine compound (4) and pyridone compound (4), respectively, in Production Example 2.

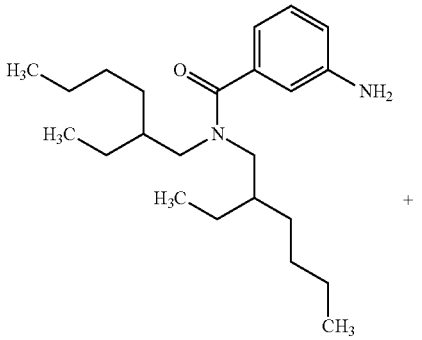

Amine compound (4)

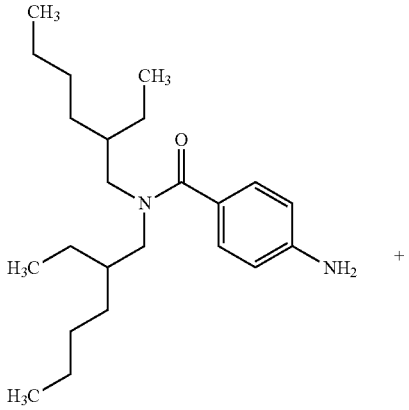

Amine compound (5)

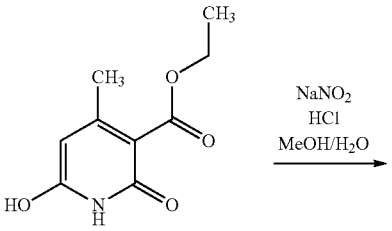

Pyridone compound (4)

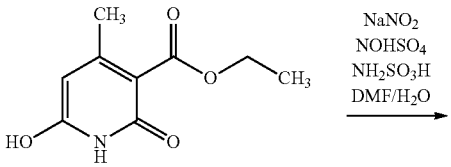

Pyridone compound (5)

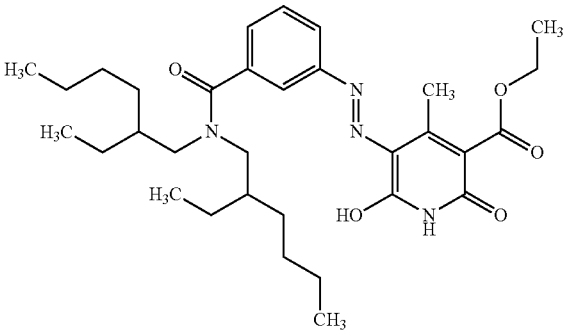

Compound (11)

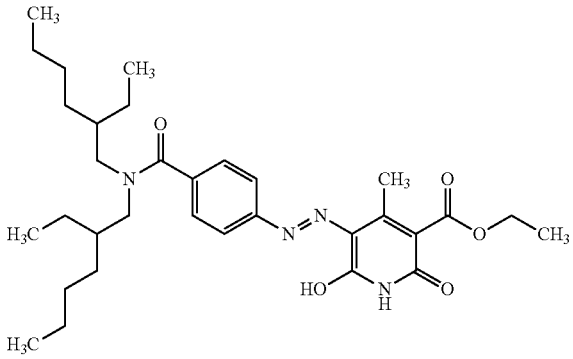

Compound (18)

[The analysis result of the compound (11)]

[1] $^1$H-NMR (400 MHz, $CDCl_3$, room temperature): δ [ppm]=0.72 (3H, t, J=7.25 Hz), 0.82 (3H, t, J=7.25 Hz), 0.89-0.99 (6H, m), 1.02-1.13 (4H, m), 1.15-1.26 (3H, m), 1.28-1.46 (12H, m), 1.74-1.88 (2H, m), 2.34 (3H, s), 3.18 (2H, d, J=6.87 Hz), 3.42-3.49 (2H, m), 4.40 (2H, q, J=7.12 Hz), 7.17-7.20 (1H, m), 7.40-7.49 (2H, m), 7.48 (1H, s), 8.87 (1H, br), 14.49 (1H, s)

[2] mass spectrometry: m/z=567.708 $(M-H)^-$

[The analysis result of the compound (18)]

[1] $^1$H-NMR (400 MHz, $CDCl_3$, room temperature): δ [ppm]=0.68-0.75 (3H, m), 0.81-0.87 (3H, m), 0.89-0.98 (6H, m), 1.02-1.12 (4H, m), 1.15-1.24 (3H, m), 1.29-1.46 (12H, m), 1.75-1.84 (2H, m), 2.37 (3H, s), 3.21 (2H, d, J=6.10 Hz), 3.44 (2H, d, J=5.34 Hz), 4.41 (2H, q, J=7.12 Hz), 7.45 (4H, s), 8.78 (1H, s), 14.49 (1H, s)

[2] mass spectrometry: m/z=567.612 $(M-H)^-$

Production Example 5

Production of a Compound (18)

A compound (18) was obtained by the same operation as in Production Example 1, except for altering the amine compound (1) and the pyridone compound (1) to an amine compound (5) and a pyridone compound (5), respectively, in Production Example 1.

Production Example 6

Production of a Compound (26)

A compound (26) was obtained by the same operation as in Production Example 2, except for altering the amine compound (2) and the pyridone compound (2) to an amine compound (6) and a pyridone compound (6), respectively, in Production Example 2.

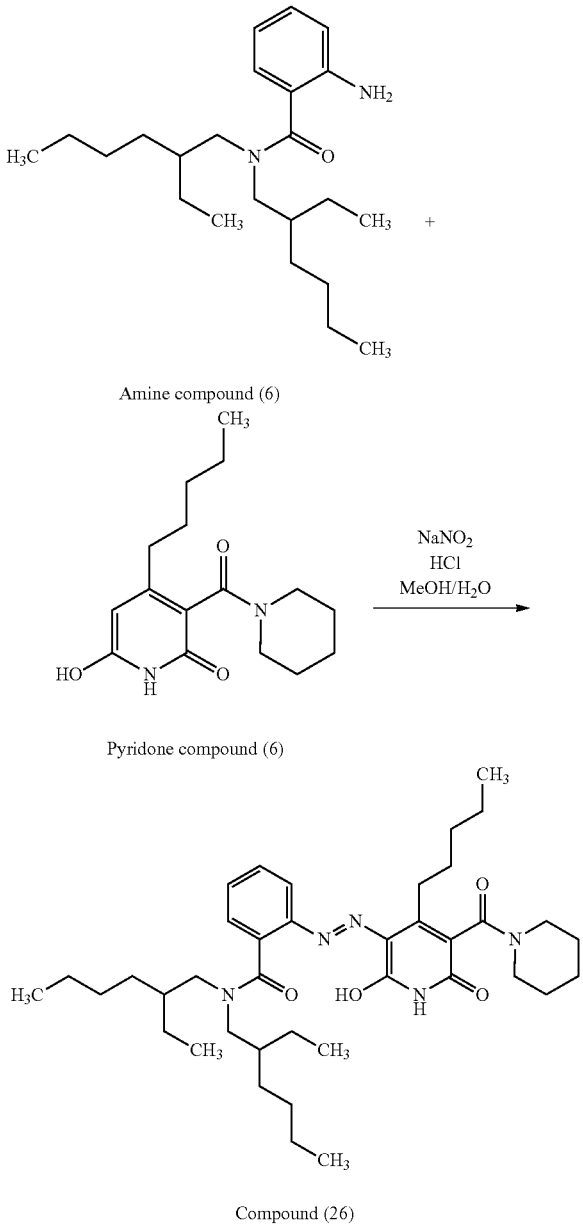

[The analysis result of the compound (26)]

[1] $^1$H-NMR (400 MHz, $CDCl_3$, room temperature): δ [ppm]=0.58-1.81 (47H, m), 2.66 (1H, br), 2.77 (1H, br), 3.22-3.36 (4H, m), 3.67-3.81 (2H, m), 7.18 (1H, t, J=7.25 Hz), 7.26 (1H, d, J=9.92 Hz), 7.45 (1H, t, J=7.63 Hz), 7.79 (1H, d, J=7.63 Hz), 8.10 (1H, s), 14.45 (1H, s)

[2] mass spectrometry: m/z=662.464 $(M-H)^-$

Production Example 7

Production of a Compound (28)

A compound (28) was obtained by the same operation as in Production Example 2, except for altering the amine compound (2) and the pyridone compound (2) to an amine compound (7) and a pyridone compound (7), respectively, in Production Example 2.

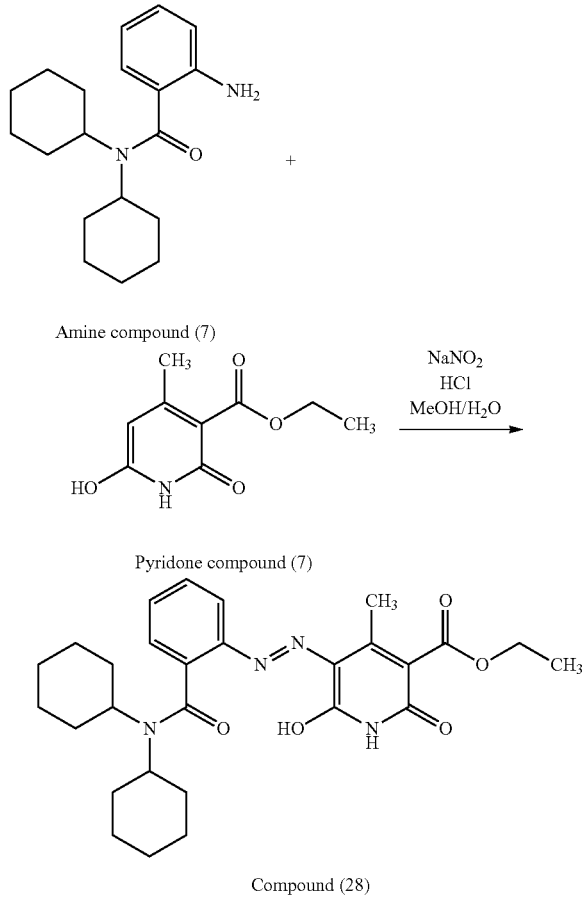

[The analysis result of the compound (28)]

[1] $^1$H-NMR (400 MHz, $CDCl_3$, room temperature): δ [ppm]=1.18-2.06 (20H, m), 2.37 (3H, s), 2.71 (1H, br), 3.23 (2H, br), 4.40 (2H, q, J=7.12 Hz), 7.19 (2H, d, J=6.10 Hz), 7.44 (2H, m), 7.75 (1H, d, J=11.06 Hz), 7.82 (1H, d, J=6.87 Hz), 8.08 (1H, s), 14.56 (1H, s)

[2] mass spectrometry: m/z=507.261 $(M-H)^-$

[Production of Yellow Toners]

The yellow toners of the present invention and comparative yellow toners were produced by methods described below.

Example 1

A mixture of 5 parts by mass of the compound (1) and 120 parts by mass of styrene was dissolved for 3 hours by using an attritor (made by Mitsui Mining Co., Ltd.) to thereby obtain a coloring matter dispersion (1).

710 parts of ion-exchange water and 450 parts of a 0.1 mol/l trisodium phosphate aqueous solution were added to a 2 L four-necked flask equipped with a high-speed stirrer T.K. Homomixer (made by Primix Corp.) with the rotation frequency being regulated at 12,000 rpm, and heated at 60° C. 68 parts of a 1.0 mol/l calcium chloride aqueous solution was gradually added thereto to thereby prepare an aqueous dispersion medium containing a fine poorly water-soluble dispersion stabilizer, calcium phosphate.

Coloring matter dispersion (1): 133.2 parts by mass

Styrene monomer: 46.0 parts by mass n-Butyl acrylate monomer: 34.0 parts by mass Aluminum salicylate compound: 2.0 parts by mass (made by Orient Chemical Industries, Ltd., Bontron E-88)

Polar resin: 10.0 parts by mass (a polycondensate of a propylene oxide-modified bisphenol A with isophthalic acid, Tg=65° C., Mw=10,000, Mn=6,000)

Ester wax: 25.0 parts by mass (the maximum endothermic peak temperature in DSC measurement=70° C., Mn=704)

Divinylbenzene monomer: 0.10 part by mass

The above formulation was heated at 60° C., and homogeneously dissolved and dispersed at 5,000 rpm using a T.K. Homomixer. 10 parts by mass of 2,2'-azobis(2,4-dimethylvaleronitrile) being a polymerization initiator was dissolved therein to thereby prepare a polymerizable monomer composition. The polymerizable monomer composition was charged in the above aqueous medium and the resultant was granulated for 15 min while the rotation frequency was maintained at 12,000 rpm. Thereafter, a stirrer was changed from the high-speed stirrer to a propeller stirrer blade; the polymerization was continued at a liquid temperature of 60° C. for 5 hours, and was further continued at a raised liquid temperature of 80° C. for 8 hours. After the completion of the polymerization reaction, the remaining monomer was distilled out at 80° C. under reduced pressure, and thereafter, the liquid temperature was cooled to 30° C. and a polymer fine particle dispersion was obtained.

Then, the polymer fine particle dispersion was transferred to a washing vessel; and dilute hydrochloric acid was added thereto with stirring to regulate the pH to 1.5, and stirred for 2 hours. The resultant was subjected to solid-liquid separation using a filter to thereby obtain a polymer fine particle. The redispersion of the polymer fine particle in water and the solid-liquid separation were repeatedly carried out until the compound of phosphoric acid and calcium containing calcium phosphate was sufficiently removed. Thereafter, the polymer fine particle having been subjected to the final solid-liquid separation was sufficiently dried with a drying machine to thereby obtain a yellow toner particle (1).

To 100 parts by mass of the obtained yellow toner particle (1), 1.00 part by mass of a hydrophobic silica fine powder (number-average primary particle diameter: 7 nm) surface-treated with hexamethyldisilazane, 0.15 part by mass of a rutile-type titanium oxide fine powder (number-average primary particle diameter: 45 nm), and 0.50 part by mass of a rutile-type titanium oxide fine powder (number-average primary particle diameter: 200 nm) were dry-mixed for 5 min with a HENSCHEL mixer (made by Nippon Coke & Engineering Co., Ltd.) to thereby obtain a yellow toner (1) of the present invention.

Examples 2 to 4

Yellow toners (2) to (4) according to the present invention were obtained in the same manner as in Example 1, except for altering the compound (1) to 6 parts by mass of the compound (4), 7 parts by mass of the compound (11), and 7 parts by mass of the compound (26), respectively, in Example 1.

Comparative Example 1

A comparative yellow toner (comparative 1) was obtained in the same manner as in Example 1, except for changing the compound (1) to the following comparative compound (1), in Example 1.

The comparative compounds (1) were as follows.

Comparative compound (1)

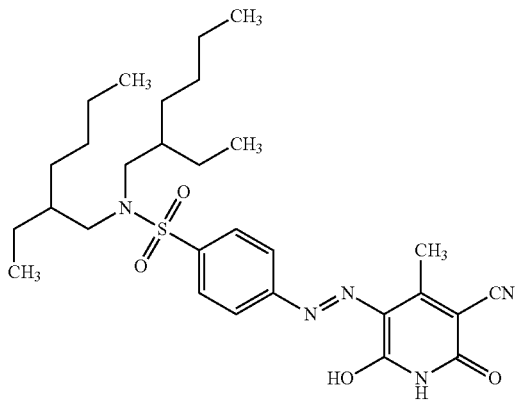

Example 5

82.6 parts by mass of styrene, 9.2 parts by mass of n-butyl acrylate, 1.3 parts by mass of acrylic acid, 0.4 part by mass of hexanediol acrylate, and 3.2 parts by mass of n-laurylmercaptane were mixed and dissolved. An aqueous solution having 1.5 parts by mass of Neogen RK (made by Daiichi Kogyo Seiyaku Co., Ltd.) and 150 parts by mass of ion-exchange water was added to and dispersed in the solution. An aqueous solution having 0.15 part by mass of potassium persulfate and 10 parts by mass of ion-exchange water was further added to the resultant while the resultant was slowly stirred for 10 min. After nitrogen replacement, the emulsion polymerization was carried out at 70° C. for 6 hours. After the completion of the polymerization, the reaction liquid was cooled to room temperature, and ion-exchange water was added to thereby obtain a resin particle dispersion liquid having a solid content concentration of 12.5% by mass and a median diameter in terms of volume of the resin particle of 0.2 μm.

100 parts by mass of the ester wax (the maximum endothermic peak temperature in DSC measurement=70° C., Mn=704), and 15 parts by mass of Neogen RK were mixed with 385 parts by mass of ion-exchange water, and dispersed for about 1 hour using a wet-type jet mill JN100 (made by Jokoh Co., Ltd.) to thereby obtain a wax dispersion liquid. The concentration of the wax in the wax dispersion liquid was 20% by mass.

100 parts by mass of the compound (1) and 15 parts by mass of Neogen RK were mixed with 885 parts by mass of ion-exchange water, and dispersed for about 1 hour using a wet-type jet mill JN100 (made by Jokoh Co., Ltd.) to thereby obtain a compound (1) dispersion liquid.

The median diameter in terms of volume of the colorant particle in the compound (1) dispersion liquid was 0.2 μm, and the concentration of the compound (1) in the compound (1) dispersion liquid was 10% by mass.

160 parts by mass of the above resin particle dispersion liquid, 10 parts by mass of the wax dispersion liquid, 10 parts by mass of the compound (1) dispersion liquid, and 0.2 part by mass of magnesium sulfate were dispersed using a homogenizer (made by IKA-Werke GmbH & Co. KG, Ultra-Turrax T50), and heated to 65° C. with stirring. After the stirring at 65° C. for 1 hour, the mixture was observed with an optical microscope, and the formation of aggregate particles having an average particle diameter of about 6.0 μm was confirmed.

After 2.2 parts of Neogen RK (Daiichi Kogyo Seiyaku Co., Ltd.) was added, the mixture was heated to 80° C., and stirred for 120 min to thereby obtain fused spherical toner particles. A solution containing the toner particles was cooled, and thereafter filtered, and the filtered-out solid was stirred and washed with 720 parts of ion-exchange water for 60 min. The similar washing was repeated until a solution containing the toner particles was filtered and the electroconductivity of the filtrate became 150 μS/cm or less. The filtrand was dried using a vacuum drier to thereby obtain a toner particle (5).

100 parts by mass of the toner particle (5) was dry-mixed with 1.8 parts by mass of the hydrophobized silica fine powder having a specific surface area of 200 $m^2/g$ as measured by BET method using a HENSCHEL mixer (Mitsui Mining Co., Ltd.) to thereby obtain a yellow toner (5) of the present invention.

Examples 6 and 7

Yellow toners (6) and (7) according to the present invention were obtained in the same manner as in Example 1, except for altering the compound (1) to the compound (18), and the compound (28), respectively, in Example 5.

Comparative Example 2

A comparative yellow toner (comparative 2) was obtained in the same manner as in Example 5, except for altering the compound (1) to the comparative compound (2), in Example 5.

Comparative compound (2)

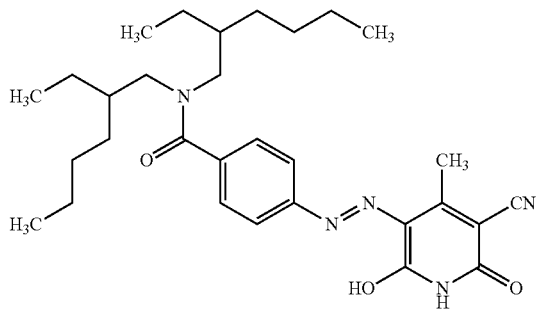

Example 8

100 parts by mass of a binder resin (polyester resin) (Tg: 55° C., acid value: 20 mgKOH/g, hydroxyl value: 16 mgKOH/g, molecular weight: Mp: 4,500, Mn: 2,300, Mw: 38,000), 5 parts by mass of the compound (4), 0.5 part by mass of an aluminum 1,4-di-t-butylsalicylate compound, and 5 parts by mass of a paraffin wax (maximum endothermic peak temperature: 78° C.) were sufficiently mixed with a HENSCHEL mixer (FM-75J, made by Mitsui Mining Co., Ltd.), and thereafter kneaded (the temperature of a kneaded material in discharge was about 150° C.) with a twin-screw kneading machine (PCM-45, made by Ikegai Corp.) whose temperature was set at 130° C. in a feed amount of 60 kg/hr. The obtained kneaded material was cooled and coarsely pulverized with a hammer mill, and thereafter finely pulverized with a mechanical crusher (T-250, made by Turbo Kogyo Co., Ltd.) in a feed amount of 20 kg/hr.

An obtained toner fine pulverized material was further classified with a multi-division classifying machine utilizing the Coanda effect to thereby obtain a toner particle (8).

100 parts by mass of the toner particle (8) was dry-mixed with 1.8 parts of a hydrophobized silica fine powder having a specific surface area of 200 $m^2/g$ as measured by BET method with a HENSCHEL mixer (made by Mitsui Mining Co., Ltd.) to thereby obtain a yellow toner (8).

Examples 9 and 10

Yellow toners (9) and (10) according to the present invention were obtained in the same manner as in Example 8, except for altering the compound (4) to 5 parts by mass of the compound (23), and 6 parts by mass of the compound (28), respectively, in Example 8.

Comparative Example 3

A yellow toner (comparative 3) of the present invention was obtained in the same manner as in Example 8, except for altering the compound (4) to the comparative compound (2), in Example 3.

Example 11

A yellow toner (11) according to the present invention was obtained in the same manner as in Example 1, except for altering the compound (1) to 4 parts by mass of C.I. Pigment Yellow 185 (made by BASF, trade name: "PALIOTOL Yellow D1155") and 3 parts by mass of the compound (1), in Example 1.

Comparative Example 4

A comparative yellow toner (comparative 4) was obtained in the same manner as in Example 11, except for not using the compound (1), and instead using 7 parts by mass of C.I. Pigment Yellow 185 (made by BASF, trade name: "PALIOTOL Yellow D1155") alone, in Example 11.

Example 12

A resin particle dispersion liquid having a solid content concentration of 12.5% by mass and a median diameter in terms of volume of the resin particle of 0.2 μm, and a wax dispersion liquid having a wax concentration of 20% by mass were obtained in the same manner as in Example 5.

100 parts by mass of C.I. Pigment Yellow 180 (made by DIC Corp., trade name: "SYMULER Fast Yellow BY2000GT") and 15 parts by mass of Neogen RK were mixed with 885 parts by mass of ion-exchange water, and dispersed for about 1 hour by using a wet-type jet mill JN100 (made by Jokoh Co., Ltd.) to thereby obtain a C.I. Pigment Yellow 180 dispersion liquid.

The median diameter in terms of volume of the colorant particle in the C.I. Pigment Yellow 180 dispersion liquid was 0.2 μm, and the concentration of the C.I. Pigment Yellow 180 in the C.I. Pigment Yellow 180 dispersion liquid was 10% by mass.

100 parts by mass of the compound (18) and 15 parts by mass of Neogen RK were mixed with 885 parts by mass of ion-exchange water, and dispersed for about 1 hour by using a wet-type jet mill JN100 (made by Jokoh Co., Ltd.) to thereby obtain a compound (18) dispersion liquid.

The median diameter in terms of volume of the colorant particle in the compound (18) dispersion liquid was 0.2 μm, and the concentration of the compound (18) in the compound (18) dispersion liquid was 10% by mass.

160 parts by mass of the resin particle dispersion liquid, 10 parts by mass of the wax dispersion liquid, 3 parts by mass of the C.I. Pigment Yellow 180 dispersion liquid, 4 parts by mass of the compound (18) dispersion liquid, and 0.2 part by mass of magnesium sulfate were dispersed by using a homogenizer (made by IKA-Werke GmbH & Co. KG, Ultra Turrax T50), and thereafter heated to 65° C. under stirring. The mixture was stirred at 65° C. for 1 hour; and the resultant was thereafter observed by an optical microscope, and it was confirmed that aggregate particles having an average particle diameter of about 6.0 μm were formed. 2.2 parts by mass of Neogen RK (made by Daiichi Kogyo Seiyaku Co., Ltd.) was added thereto, and thereafter heated to 80° C., and stirred for 120 min to thereby obtain fused spherical toner particles. After cooling, the resultant was filtered, and a filtrand solid was stirred in and washed with 720 parts by mass of ion-exchange water for 60 min. The operation was repeated in which the solution containing the toner particles was filtered, and the filtrand toner particles were similarly washed, until the electroconductivity of the filtrate became 150 μS/cm or less. The toner particles were dried using a vacuum drier to thereby obtain a toner particle (12).

100 parts by mass of the toner particle (12) was dry-mixed with 1.8 parts of a hydrophobized silica fine powder having a specific surface area of 200 $m^2/g$ as measured by BET method with a HENSCHEL mixer (Mitsui Mining Co., Ltd.) to thereby obtain a yellow toner (12).

Comparative Example 5

A yellow toner (comparative 5) was obtained in the same manner as in Example 12, except for not using the compound (18), and instead using 7 parts by mass of C.I. Pigment Yellow 180 alone, in Example 12.

Example 13

100 parts by mass of a binder resin (polyester resin)(Tg: 55° C., acid value: 20 mgKOH/g, hydroxyl value: 16 mgKOH/g, molecular weight: Mp: 4,500, Mn: 2,300, Mw: 38,000), 3 parts by mass of C.I. Pigment Yellow 155 (made by Clariant International Ltd., trade name: "Toner Yellow 3GP"), 3 parts by mass of the compound (4), 0.5 part by mass of aluminum 1,4-di-t-butylsalicylate compound, and 5 parts by mass of a paraffin wax (maximum endothermic peak temperature: 78° C.) were well mixed with a HENSCHEL mixer (FM-75J type, made by Mitsui Mining Co., Ltd.), and thereafter kneaded (the temperature of the kneaded material in discharge was about 150° C.) with a twin-screw kneading machine (PCM-45, made by Ikegai Corp.) whose temperature was set at 130° C. in a feed amount of 60 kg/hr. The obtained kneaded material was cooled and coarsely pulverized with a hammer mill, and thereafter finely pulverized with a mechanical crusher (T-250, made by Turbo Kogyo Co., Ltd.) in a feed amount of 20 kg/hr.

An obtained toner finely pulverized material was further classified with a multi-division classifying machine utilizing the Coanda effect to thereby obtain a toner particle (13).

100 parts by mass of the toner particle (13) was dry-mixed with 1.8 parts by mass of a hydrophobized silica fine powder having a specific surface area of 200 $m^2/g$ as measured by BET method with a HENSCHEL mixer (made by Mitsui Mining Co., Ltd.) to thereby obtain a yellow toner (13).

Comparative Example 6

A comparative yellow toner (comparative 6) was obtained in the same manner as in Example 13, except for not using the compound (4), and instead using 7 parts by mass of C.I. Pigment Yellow 155 (made by Clariant International Ltd., trade name: "Toner Yellow 3GP") alone, in Example 13.

Hereinafter, measurement methods and evaluation methods of physical properties of the toners obtained as described above will be described.

(1) Measurements of a Weight-Average Particle Diameter (D4) and a Number-Average Particle Diameter (D1) of a Toner The number-average particle diameter (D1) and the weight-average particle diameter (D4) of the above toner were measured with the particle size distribution analyzer using the Coulter method. The measurement used, as the measurement apparatus, a Coulter Counter TA-II or a Coulter Multisizer II (made by Beckman Coulter, Inc.), and was carried out according to the operation manual of the apparatus. As an electrolyte solution, an about 1% sodium chloride aqueous solution was prepared by using an extrapure sodium chloride. For example, ISOTON-II (made by Coulter Scientific Japan Co., Ltd.) can be used. The specific measurement method was such that 0.1 to 5 ml of a surfactant (which can be an alkylbenzenesulfonate salt) as a dispersant was added to 100 to 150 ml of the above electrolytic aqueous solution, and 2 to 20 mg of the measurement sample (toner) was further added. The electrolyte solution in which the sample was suspended was subjected to a disperse treatment for about 1 to 3 min with an ultrasonic disperser. The obtained dispersed liquid was loaded on the above measurement apparatus equipped with an aperture of 100 μm, and the volume and the number of the toner particles of 2.00 μm or more were measured with the measurement apparatus and the volume distribution and the number distribution of the toner were calculated. Then, the number-average particle diameter (D1) was determined from the number distribution of the toner, and the weight-average particle diameter (D4) of the toner was determined from the volume distribution of the toner particles (a median value of each channel was taken as a representative value of the each channel), and D4/D1 was determined.

The above channels were 13 channels of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

(2) Measurement of a 50%-cumulative Particle Diameter Value (D50) in Terms of Volume of the Toner A 50%-cumulative particle diameter value (D50) in terms of volume of the toner was measured by using an apparatus used in the measurement of the weight-average particle diameter (D4) and the number-average particle diameter (D1) of the toner described in the above (1), and three-dimensionally measuring the particle volume based on the Coulter principle.

(3) Measurement of an Average Degree of Circularity of a Toner

The circularity was measured using a flow-type particle image measurement apparatus "FPIA-2100" (made by Sysmex Corp.), and the average degree of circularity was calculated using the following expression.

$$\text{Equivalent-circle diameter} = \sqrt{(\text{particle projection area}/\pi)} \times 2$$

$$\text{Degree of circularity} = (\text{perimeter of a circle of the same area as the particle projection area})/(\text{perimeter of a particle projection image})$$

Here, the "particle projection area" is defined as an area of a binarized toner particle image, and the "perimeter of a particle projection image" is defined as a length of outlines obtained by connecting edge points of the toner particle image. The degree of circularity is an index indicating the degree of irregularity of a particle; in the case where a particle has a complete spherical shape, the degree of circularity is 1.000, and the more complex the surface shape, the smaller value the degree of circularity has.

(4) Evaluation of Image Samples Using the Yellow Toners

Then, by using above-mentioned yellow toners (1) to (13) and Comparative yellow toners (comparative 1) to (comparative 6), image samples were outputted, and image properties described later were comparatively evaluated. Here, when the image properties were compared, paper-passing durability tests were carried out using a remodeled machine of LBP-5300 (made by Canon Corp.) as an image formation apparatus (hereinafter, abbreviated to LBP). The remodeling content was such that the developing blade in the process cartridge (hereinafter, abbreviated to CRG) was replaced by a SUS blade of 8 μm in thickness. Besides, a blade bias of −200 V was designed to be applied vs. a development bias applied to a development roller being a toner carrier.

For the evaluation, each CRG in which each yellow toner was individually filled was prepared for every evaluation item. The each CRG in which the each toner was filled was set on the LBP, and was evaluated for every evaluation item described below.

<Measurement of the Color Gamut>

16-gradation image samples in which a maximum toner loading amount was adjusted at 0.45 mg/cm$^2$ were fabricated under the ordinary environment (temperature: 25° C., humidity: 60% RH) by using a color copying machine CLC-1100 remodeled machine (made by Canon Corp., the fixing oil coating mechanism was removed). At this time, as a base paper of the image sample, a CLC color copy sheet (made by Canon Corp.) was used. The obtained image samples were measured for the chromaticity (L*, a*, b*) in the L*a*b* color space by using a spectrophotometer SpectroLino (made by Gretag Machbeth Co.). The chroma (c*) was calculated by the following expression based on the measurement value of the color property.

$$c^*=\sqrt{(a^*)^2+(b^*)^2}$$

[Evaluation of the color tone]

The color tone was evaluated as follows.

A larger extension of the chromaticity in the green gamut direction in a same L* can be said to be more useful for extension of the green color gamut. The evaluation was carried out using values of a* and b* when L* was 92. The a* and b* when L* was 92 were determined by interpolation from the L*, a*, b* obtained for each image sample. In evaluations described below, A means that the extension of a chromaticity toward the green color gamut direction is large; and the extension of a chromaticity toward the green color gamut direction is smaller in the order of A, B, and C.

A: a* was less than −5.0, and b* was 100.0 or more

B: a* was −5.0 or more, and b* was 100.0 or more

C: a case excluding the conditions of the above A and B

<Evaluation of the Chroma>

The chroma was evaluated as follows.

A higher chroma c* at an amount of a colorant per a same unit area can be said to exhibit better extension of the chroma. The evaluation was carried out using the chroma c* when an image sample was fabricated by Bar-Coating method (Bar No. 10) described above. Here, was calculated by the above expression.

A: c* was 112.0 or more

B: c* was 108.0 or more and less than 112.0

C: c* was less than 108.0

The above evaluation results are shown in Table 1. In Table 1, PY185, PY180, and PY155 indicate C.I. Pigment Yellow 185, C.I. Pigment Yellow 180, and C.I. Pigment Yellow 155, respectively.

TABLE 1

| | | | | | | Average | Color Tone at L* = 92 | | | Chroma | |
|---|---|---|---|---|---|---|---|---|---|---|---|
| | Toner No. | Compound No. | Toner | D50 | D4/D1 | Degree of Circularity | a* | b* | Color Tone Evaluation | c* | Chroma Evaluation |
| Example 1 | Yellow Toner (1) | Compound (1) | Suspension Polymerization Method | 5.93 | 1.28 | 0.974 | −11.0 | 109.1 | A | 109.7 | B |
| Example 2 | Yellow Toner (2) | Compound (4) | Suspension Polymerization Method | 6.24 | 1.21 | 0.969 | −9.9 | 113.0 | A | 113.4 | A |
| Example 3 | Yellow Toner (3) | Compound (11) | Suspension Polymerization Method | 5.99 | 1.30 | 0.976 | −10.8 | 108.9 | A | 109.4 | B |
| Example 4 | Yellow Toner (4) | Compound (26) | Suspension Polymerization Method | 5.62 | 1.29 | 0.972 | −10.8 | 112.2 | A | 112.7 | A |
| Example 5 | Yellow Toner (5) | Compound (1) | Emulsion-Aggregation Method | 6.23 | 1.27 | 0.981 | −8.7 | 116.8 | A | 117.1 | A |
| Example 6 | Yellow Toner (6) | Compound (18) | Emulsion-Aggregation Method | 7.01 | 1.26 | 0.968 | −9.1 | 114.8 | A | 115.2 | A |
| Example 7 | Yellow Toner (7) | Compound (28) | Emulsion-Aggregation Method | 6.88 | 1.27 | 0.974 | −9.0 | 115.2 | A | 115.6 | A |
| Example 8 | Yellow Toner (8) | Compound (4) | Pulverization Method | 6.47 | 1.13 | 0.920 | −10.9 | 112.4 | A | 112.9 | A |
| Example 9 | Yellow Toner (9) | Compound (23) | Pulverization Method | 6.13 | 1.15 | 0.910 | −10.7 | 111.6 | A | 112.1 | A |
| Example 10 | Yellow Toner (10) | Compound (28) | Pulverization Method | 6.12 | 1.15 | 0.922 | −10.6 | 114.0 | A | 114.5 | A |
| Example 11 | Yellow Toner (11) | PY185 Compound (1) | Suspension Polymerization Method | 5.84 | 1.30 | 0.965 | −11.0 | 111.8 | A | 112.3 | A |

TABLE 1-continued

| | Toner No. | Compound No. | Toner | D50 | D4/D1 | Average Degree of Circularity | Color Tone at L* = 92 a* | Color Tone at L* = 92 b* | Color Tone Evaluation | Chroma c* | Chroma Evaluation |
|---|---|---|---|---|---|---|---|---|---|---|---|
| Example 12 | Yellow Toner (12) | PY180 Compound (18) | Emulsion-Aggregation Method | 6.39 | 1.25 | 0.971 | −10.5 | 111.0 | A | 111.5 | B |
| Example 13 | Yellow Toner (13) | PY155 Compound (4) | Pulverization Method | 6.05 | 1.19 | 0.933 | −10.0 | 112.2 | A | 112.6 | A |
| Comparative Example 1 | Yellow Toner (Comparative 1) | Comparative Compound (1) | Suspension Polymerization Method | 7.12 | 1.42 | 0.961 | −3.1 | 103.2 | B | 103.2 | C |
| Comparative Example 2 | Yellow Toner (Comparative 2) | Comparative Compound (2) | Emulsion-Aggregation Method | 6.66 | 1.51 | 0.958 | −6.4 | 89.2 | C | 89.4 | C |
| Comparative Example 3 | Yellow Toner (Comparative 3) | Comparative Compound (2) | Pulverization Method | 6.58 | 1.14 | 0.920 | −6.4 | 89.2 | C | 89.4 | C |
| Comparative Example 4 | Yellow Toner (Comparative 4) | PY185 | Suspension Polymerization Method | 5.96 | 1.23 | 0.970 | −8.2 | 105.0 | A | 105.3 | C |
| Comparative Example 5 | Yellow Toner (Comparative 5) | PY180 | Emulsion-Aggregation Method | 6.01 | 1.26 | 0.960 | −6.8 | 100.0 | A | 100.2 | C |
| Comparative Example 6 | Yellow Toner (Comparative 6) | PY155 | Pulverization Method | 6.32 | 1.19 | 0.910 | −4.2 | 95.0 | C | 95.1 | C |

As shown in Table 1, it is clear that the yellow toners obtained in the present invention had better chroma than the corresponding comparative yellow toners, and the effect of using the compounds represented by the general formula (1) according to the present invention is recognized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-190503, filed Aug. 30, 2012, which is hereby incorporated by reference herein in its entirety.

What is claimed is:

1. A yellow toner comprising toner particles, each of which comprises a binder resin and a colorant, wherein the colorant comprises a compound represented by the following general formula (1):

General Formula (1)

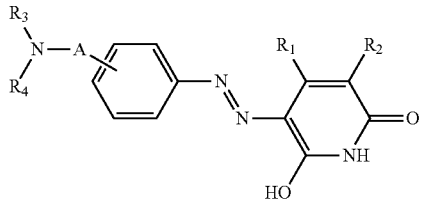

wherein $R_1$ represents an alkyl group, an aryl group, or an amino group;

$R_2$ represents a functional group selected from the group consisting of a carboxylate ester group, a carboxylic acid dialkylamide group, a carboxylic acid diphenylamide group, a carboxylic acid monoalkylamide group and a carboxylic acid monophenylamide group;

A represents a carbonyl group or a sulfonyl group; and both $R_3$ and $R_4$ represent a cyclohexyl group or both $R_3$ and $R_4$ represent a 2-ethylhexyl group.

2. The yellow toner according to claim 1, wherein $R_1$ in the general formula (1) is an alkyl group.

3. The yellow toner according to claim 1, wherein $R_2$ in the general formula (1) is a carboxylate ester group.

4. The yellow toner according to claim 1, wherein each of the toner particles further comprises a wax.

* * * * *